US009052131B2

(12) United States Patent
Reimann et al.

(10) Patent No.: US 9,052,131 B2
(45) Date of Patent: Jun. 9, 2015

(54) DAMPER APPARATUS FOR TRANSPORT REFRIGERATION SYSTEM, TRANSPORT REFRIGERATION UNIT, AND METHODS FOR SAME

(75) Inventors: Robert C. Reimann, Lafayette, NY (US); Timothy R. Campbell, Marcelleus, NY (US); Belin G. Czechowicz, Jamesville, NY (US); Patrick McDonald, Athens, GA (US); John R. Reason, Liverpool, NY (US)

(73) Assignee: CARRIER CORPORATION, Farmington, CT (US)

( * ) Notice: Subject to any disclaimer, the term of this patent is extended or adjusted under 35 U.S.C. 154(b) by 134 days.

(21) Appl. No.: 13/390,356

(22) PCT Filed: Aug. 16, 2010

(86) PCT No.: PCT/US2010/045617

§ 371 (c)(1),
(2), (4) Date: Feb. 14, 2012

(87) PCT Pub. No.: WO2011/022331

PCT Pub. Date: Feb. 24, 2011

(65) Prior Publication Data

US 2012/0137710 A1 Jun. 7, 2012

Related U.S. Application Data

(60) Provisional application No. 61/234,858, filed on Aug. 18, 2009, provisional application No. 61/247,791, filed on Oct. 1, 2009.

(51) Int. Cl.

| | |
|---|---|
| ***F25D 17/06*** | (2006.01) |
| ***F25D 17/04*** | (2006.01) |
| ***F24F 13/10*** | (2006.01) |

(52) U.S. Cl.
CPC ..... *F25D 17/045* (2013.01); *F24F 13/10* (2013.01)

(58) Field of Classification Search
CPC ..... F25D 17/045; F25D 17/06; F24F 13/10
USPC ..... 62/89, 335, 126, 404, 426, 187, 498, 62/278, 276, 277, 157, 239; 29/890.035; 454/105, 265
See application file for complete search history.

(56) References Cited

U.S. PATENT DOCUMENTS

| | | | | |
|---|---|---|---|---|
| 1,949,640 | A * | 3/1934 | Anderson | 62/231 |
| 2,142,568 | A * | 1/1939 | Lowry | 34/303 |

(Continued)

FOREIGN PATENT DOCUMENTS

| | | |
|---|---|---|
| JP | 9206496 | 8/1997 |
| JP | 9264649 | 10/1997 |

(Continued)

OTHER PUBLICATIONS

International Search Report and Written Opinion mailed Mar. 31, 2011.

(Continued)

*Primary Examiner* — Mohammad M Ali
(74) *Attorney, Agent, or Firm* — Cantor Colburn LLP

(57) ABSTRACT

Embodiments of systems, apparatus, and/or methods can provide a damper assembly for transport refrigeration systems. One embodiment can include a damper assembly including a damper door configured to operate in a first position (e.g., closed), a second position (e.g., open), and at least one intermediate position. In one embodiment, a plurality of intermediate positions can be used to controllably vary a capacity of the transport refrigeration unit, or at least one component thereof. Embodiments of systems, apparatus, and/or methods can provide a damper assembly that can be accessed though an ambient portion of transport refrigeration systems or components.

23 Claims, 13 Drawing Sheets

(56) References Cited

U.S. PATENT DOCUMENTS

| | | | | | |
|---|---|---|---|---|---|
| 3,343,473 | A | * | 9/1967 | Gillick et al. | 454/99 |
| 3,359,752 | A | * | 12/1967 | Westling et al. | 62/239 |
| 3,650,318 | A | * | 3/1972 | Avery | 165/215 |
| 3,911,953 | A | * | 10/1975 | Crombie et al. | 137/595 |
| 3,958,628 | A | * | 5/1976 | Padden | 165/222 |
| 4,120,174 | A | * | 10/1978 | Johnston | 62/256 |
| 4,205,783 | A | * | 6/1980 | Dietsche et al. | 236/1 G |
| 4,262,652 | A | * | 4/1981 | Butzen | 126/285 B |
| 4,413,613 | A | * | 11/1983 | Dunlap | 126/292 |
| 4,441,333 | A | | 4/1984 | Mayer | |
| 4,582,124 | A | * | 4/1986 | Yoshimi et al. | 165/202 |
| 4,922,728 | A | | 5/1990 | Backus | |
| 5,201,185 | A | | 4/1993 | Hanson et al. | |
| 5,320,167 | A | | 6/1994 | Johnson et al. | |
| 5,533,357 | A | | 7/1996 | Voorhis | |
| 5,555,736 | A | | 9/1996 | Wills et al. | |
| 5,557,938 | A | | 9/1996 | Hanson et al. | |
| 5,560,589 | A | * | 10/1996 | Gran et al. | 267/3 |
| 5,579,648 | A | | 12/1996 | Hanson et al. | |
| 5,816,066 | A | * | 10/1998 | Aoki et al. | 62/325 |
| 6,430,951 | B1 | * | 8/2002 | Iritani et al. | 62/229 |
| 6,457,402 | B1 | | 10/2002 | Parker et al. | |
| 6,629,886 | B1 | * | 10/2003 | Estepp | 454/236 |
| 6,698,212 | B2 | | 3/2004 | Viegas et al. | |
| 6,923,111 | B2 | * | 8/2005 | Kiefer et al. | 99/468 |
| 6,996,997 | B2 | * | 2/2006 | Wiff et al. | 62/127 |
| 7,032,395 | B2 | | 4/2006 | Hanson et al. | |
| 7,043,927 | B2 | | 5/2006 | Burchill et al. | |
| 2003/0024256 | A1 | | 2/2003 | Hanson | |
| 2003/0159595 | A1 | | 8/2003 | Kiefer et al. | |
| 2004/0172954 | A1 | | 9/2004 | Hanson et al. | |
| 2005/0189100 | A1 | * | 9/2005 | Kawahara et al. | 165/202 |
| 2006/0248904 | A1 | | 11/2006 | Ludwig | |
| 2008/0287052 | A1 | * | 11/2008 | Cook et al. | 454/256 |
| 2009/0049851 | A1 | | 2/2009 | Regan | |

FOREIGN PATENT DOCUMENTS

| | | |
|---|---|---|
| JP | 2009068814 | 4/2009 |
| KR | 20010035165 | 5/2001 |
| KR | 20070072240 | 7/2007 |
| WO | W02009026356 A2 | 2/2009 |

OTHER PUBLICATIONS

International Search Report and Written Opinion of Application No. 201201134-1, dated Jun. 11, 2013, 9 pages.

Singapore Examination Report and Search Report for Singapore Patent Application No. 201201134-2, Jan. 23, 2014, 9 pages.

* cited by examiner

DAMPER APPARATUS FOR TRANSPORT REFRIGERATION SYSTEM, TRANSPORT REFRIGERATION UNIT, AND METHODS FOR SAME

CROSS REFERENCE TO RELATED APPLICATION

This application claims priority to U.S. Provisional Patent Application Ser. No. 61/234,858 entitled "Damper Apparatus for Transport Refrigeration System, Transport Refrigeration Unit, and Methods for Same" filed on Aug. 18, 2009 and U.S. Provisional Patent Application Ser. No. 61/247,791 entitled "Damper Apparatus for Transport Refrigeration System, Transport Refrigeration Unit, and Methods for Same" filed on Oct. 1, 2009. The content of these applications are incorporated herein by reference in their entirety.

FIELD OF THE INVENTION

This invention relates generally to the field of transport refrigeration systems and methods of operating the same.

BACKGROUND OF THE INVENTION

A particular difficulty of transporting perishable items is that such items must be maintained within a temperature range to reduce or prevent, depending on the items, spoilage, or conversely damage from freezing. A transport refrigeration unit is used to maintain proper temperatures within a transport cargo space. The transport refrigeration unit can be under the direction of a controller. The controller ensures that the transport refrigeration unit maintains a certain environment (e.g. thermal environment) within the transport cargo space. The controller can operate a transport refrigeration system including a damper assembly.

SUMMARY OF THE INVENTION

In view of the background, it is an object of the application to provide a transport refrigeration system, transport refrigeration unit, and methods of operating same that can maintain cargo quality by selectively controlling transport refrigeration system components.

One embodiment according to the application can include a control module for a transport refrigeration system. The control module includes a controller for controlling the transport refrigeration system to operate a damper.

In an aspect of the invention, a transport refrigeration unit includes a transport refrigeration unit operatively coupled to an enclosed volume. A conditioned portion of the transport refrigeration unit to include a supply port to output air to said enclosed volume at a supply temperature, a return port to return air from said enclosed volume to the transport refrigeration unit at a return temperature, an air flow between the return port and the supply port and a damper door to operatively block the air flow in a first position and pass the air flow in a second position. The transport refrigeration unit to include at least one component outside the conditioned portion and configured to move the damper door to or from the first position.

In an aspect of the invention, a transport refrigeration unit includes a damper on a first side of an insulation barrier to operatively block air flow in a defrost mode in first position. The transport refrigeration unit to include at least one component on the opposite side of the insulation barrier configured to repeatedly move the damper door from the first position during one defrost mode. In one embodiment, the at least one component is in an ambient environment of the transport refrigeration unit.

In an aspect of the invention, a transport refrigeration unit includes a transport refrigeration unit to operatively couple to an enclosed volume. The transport refrigeration unit to include a blower assembly and a supply port to output an air flow at prescribed conditions. The transport refrigeration unit to include a damper to operatively block the air flow in a first position and pass the air flow in a second position. The transport refrigeration unit to include at least one component configured to controllably reciprocally move the damper door between the first position and the second position and to controllably stop the damper door at a plurality of positions between the first position and the second position.

In an aspect of the invention, a transport refrigeration unit includes a transport refrigeration unit to operatively couple to a cargo container. A refrigerated portion of the transport refrigeration unit to include a first port to output air from an evaporator at a first temperature, a second port to provide air to the evaporator at a second (e.g., higher) temperature, a passageway between the first port and the second port, an evaporator and a damper serially positioned in the passageway between first port and the second port so that the first port can not output the air from the evaporator when the damper is in a first position. The transport refrigeration unit to include at least one component outside the refrigerated portion and operatively coupled to the damper in the passageway.

In an aspect of the invention, a transport refrigeration unit can include a compressor, a condenser downstream of the compressor, an expansion device downstream of the condenser, and an evaporator downstream of the expansion device, the transport refrigeration unit including a barrier to separate an first portion of the transport refrigeration unit to operate in a refrigerated environment from a second portion, the evaporator in the first portion, at least one damper door in the refrigerated portion, and an actuator operatively coupled to move the damper door, the actuator is positioned in the second portion.

In an aspect of the invention, a transport refrigeration unit can include a first portion of the transport refrigeration unit to be conditioned, a damper in the conditioned first portion to block a prescribed air flow, and a damper actuator operatively coupled to the damper, the damper actuator to be accessible outside the transport refrigeration unit without exposing the first portion to be conditioned.

In an aspect of the invention, a method of modifying a transport refrigeration unit having a thermal barrier between a refrigerated portion and an ambient portion can include providing an evaporator on a refrigerated side of the thermal barrier; and installing an actuator for a damper on the ambient side of the thermal barrier.

In an aspect of the invention, a damper assembly for a transport unit including a refrigeration system, the damper assembly can include a thermal housing for insulating a conditioned space, at least one damper shaft passing though the thermal housing, and an actuator coupled to the damper shaft to move the damper shaft between an open position and a closed position.

In an aspect of the invention, a transport refrigeration unit can include a compressor, a primary refrigerant circuit including heat rejection heat exchanger downstream of the compressor, and a heat absorption heat exchanger downstream of the heat rejection heat exchanger, the transport refrigeration unit including a barrier to separate a first portion of the transport refrigeration unit to operate in a refrigerated environment from a second portion, and at least one damper door in the refrigerated portion, the damper door to move between three or more positions.

In an aspect of the invention, a transport refrigeration unit can include an evaporator connected within the transport refrigeration unit, a damper configured to selectively block a prescribed air flow in communication with the evaporator, at least one sensor operatively coupled to the damper, and a controller coupled to the sensor to determine when the damper is in an intermediate position between a first position and a second position.

In one aspect of the invention, a method of modifying a transport refrigeration unit including a damper assembly can include configuring the damper to operate in a first position in a first mode of the transport refrigeration unit, and configuring the damper to vary a system capacity in a second mode of the transport refrigeration unit.

BRIEF DESCRIPTION OF THE DRAWINGS

Novel features that are characteristic of exemplary embodiments of the invention are set forth with particularity in the claims. Embodiments of the invention itself may be best be understood, with respect to its organization and method of operation, with reference to the following description taken in connection with the accompanying drawings in which:

DETAILED DESCRIPTION OF EXEMPLARY EMBODIMENTS

Figure 1:
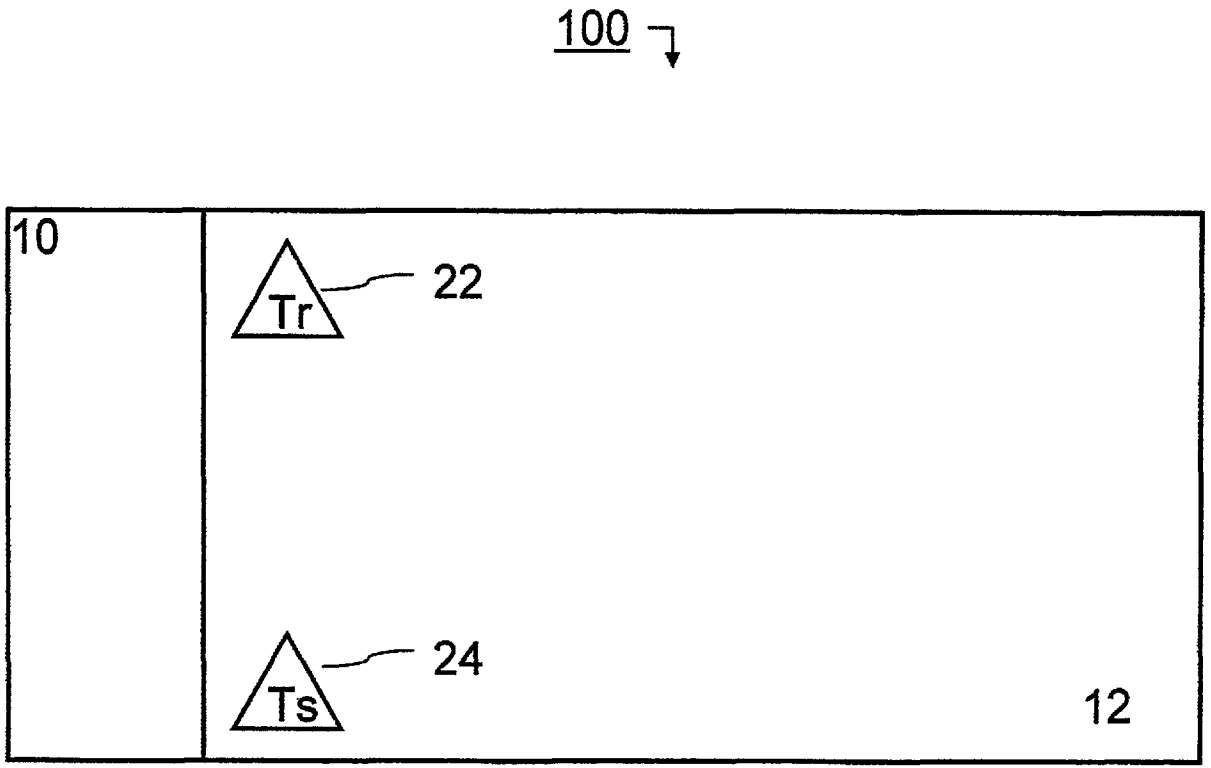
FIG. 1 is a diagram that shows an embodiment of a transport refrigeration system according to the application.

Reference will now be made in detail to exemplary embodiments of the application, examples of which are illustrated in the accompanying drawings. Whenever possible, the same reference numerals will be used throughout the drawings to refer to the same or like parts.

FIG. 1 is a diagram that shows an embodiment of a transport refrigeration system. As shown in FIG. 1, a transport refrigeration system 100 can include a transport refrigeration unit 10 coupled to an enclosed space within a container 12. The transport refrigeration system 100 may be of the type commonly employed on refrigerated trailers. As shown in FIG. 1, the transport refrigeration unit 10 is configured to maintain a prescribed thermal environment within the container 12 (e.g., cargo in an enclosed volume).

In FIG. 1, the transport refrigeration unit 10 is connected at one end of the container 12. Alternatively, the transport refrigeration unit 10 can be coupled to a prescribed position on a side or more than one side of the container 12. In one embodiment, a plurality of transport refrigeration units can be coupled to a single container 12. Alternatively, a single transport refrigeration unit 10 can be coupled to a plurality of containers 12 or multiple enclosed spaces within a single container. The transport refrigeration unit 10 can operate to induct air at a first temperature and to exhaust air at a second temperature. In one embodiment, the exhaust air from the transport refrigeration unit 10 will be warmer than the inducted air such that the transport refrigeration unit 10 is employed to warm the air in the container 12. In one embodiment, the exhaust air from the transport refrigeration unit 10 will be cooler than the inducted air such that the transport refrigeration unit 10 is employed to cool the air in the container 12. The transport refrigeration unit 10 can induct air from the container 12 having a return temperature Tr (e.g., first temperature) and exhaust air to the container 12 having a supply temperature Ts (e.g., second temperature).

In one embodiment, the transport refrigeration unit 10 can include one or more temperature sensors to continuously or repeatedly monitor the return temperature Tr and/or the supply temperature Ts. As shown in FIG. 1, a first temperature sensor 24 of the transport refrigeration unit 10 can provide the supply temperature Ts and a second temperature sensor 22 of the transport refrigeration unit 10 can provide the return temperature Tr to the transport refrigeration unit 10, respectively. Alternatively, the supply temperature Ts and the return temperature Tr can be determined using remote sensors.

A transport refrigeration system 100 can provide air with controlled temperature, humidity or/and species concentration into an enclosed chamber where cargo is stored such as in container 12. As known to one skilled in the art, the transport refrigeration system 100 (e.g., controller 250) is capable of controlling a plurality of the environmental parameters or all the environmental parameters within corresponding ranges with a great deal of variety of cargos and under all types of ambient conditions.

Figure 2:
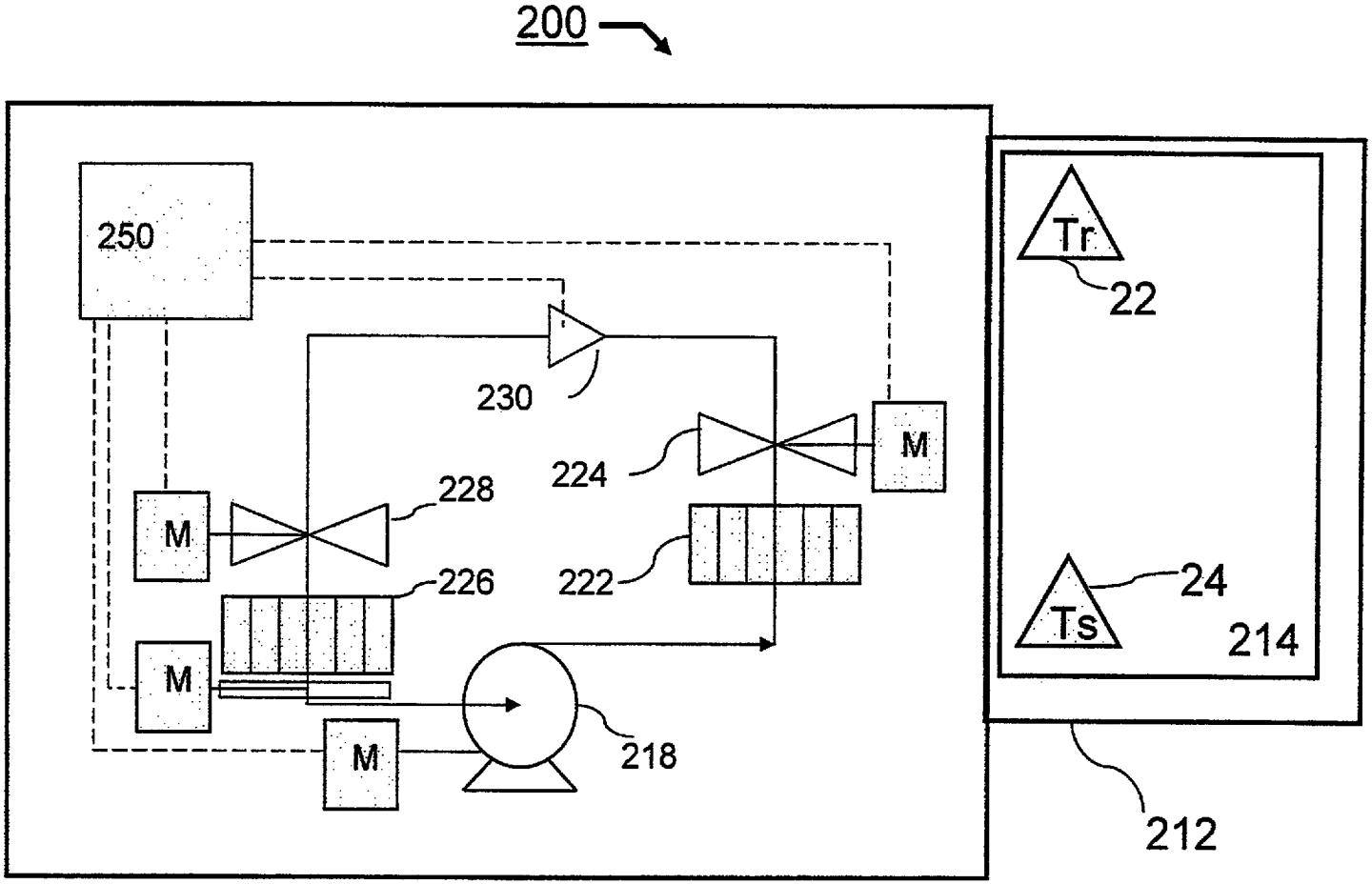
FIG. 2 is a diagram that shows an embodiment of a transport refrigeration system according to the application.

FIG. 2 is a diagram that shows an embodiment of a transport refrigeration system. As shown in FIG. 2, a transport refrigeration system 200 can include a transport refrigeration unit 210 coupled to a container 212, which can be used with a trailer, an intermodal container, a train railcar, a ship or the like, used for the transportation or storage of goods requiring a temperature controlled environment, such as, for example foodstuffs and medicines (e.g., perishable or frozen). The container 212 can include an enclosed volume 214 for the transport/storage of such goods. The enclosed volume 214 may be an enclosed space having an interior atmosphere isolated from the outside (e.g., ambient atmosphere or conditions) of the container 212.

The transport refrigeration unit 210 is located so as to maintain the temperature of the enclosed volume 214 of the container 212 within a predefined temperature range. In one embodiment, the transport refrigeration unit 210 can include a compressor 218, a condenser heat exchanger unit 222, a condenser fan 224, an evaporation heat exchanger unit 226, an evaporation fan 228, and a controller 250. Alternatively, the condenser 222 can be implemented as a gas cooler.

The compressor 218 can be powered by single phase electric power, three phase electrical power, and/or a diesel engine and can, for example, operate at a constant speed. The compressor 218 may be a scroll compressor, a rotary compressor, a reciprocal compressor, or the like. The transport refrigeration system 200 can use power from, and can be connected to a power supply unit (not shown) such as a standard commercial power service, an external power generation system (e.g., shipboard), a generator (e.g., diesel generator), or the like.

The condenser heat exchanger unit 222 can be operatively coupled to a discharge port of the compressor 218. The evaporator heat exchanger unit 226 can be operatively coupled to an input port of the compressor 218. An expansion valve 230 can be connected between an output of the condenser heat exchanger unit 222 and an input of the evaporator heat exchanger unit 226.

The condenser fan 224 can be positioned to direct an air stream onto the condenser heat exchanger unit 222. The air stream from the condenser fan 224 can allow heat to be removed from the coolant circulating within the condenser heat exchanger unit 222.

The evaporator fan 228 can be positioned to direct an air stream onto the evaporation heat exchanger unit 226. The evaporator fan 228 can be located and ducted so as to circulate the air contained within the enclosed volume 214 of the container 212. In one embodiment, the evaporator fan 230 can direct the stream of air across the surface of the evaporator heat exchanger unit 226. Heat can thereby be removed from the air, and the reduced temperature air can be circulated within the enclosed volume 214 of the container 212 to lower the temperature of the enclosed volume 214.

The controller 250 such as, for example, a MicroLink.™ 2i controller or Advance controller available from Carrier Corporation of Syracuse, N.Y., USA, can be electrically connected to the compressor 218, the condenser fan 224, and/or the evaporator fan 228. The controller 250 can be configured to operate the transport refrigeration unit 210 to maintain a predetermined environment (e.g., thermal environment) within the enclosed volume 214 of the container 212. The controller 250 can maintain the predetermined environment by selectively controlling operations of the condenser fan 224, and/or the evaporator fan 228 to operate at a low speed or a high speed. For example, if increased cooling of the enclosed volume 214 is required, the controller 250 can increase electrical power to the compressor 218, the condenser fan 224, and the evaporator fan 228. In one embodiment, an economy mode of operation of the transport refrigeration unit 210 can be controlled by the controller 250. In another embodiment, variable speeds of components (e.g., compressor 218) of the transport refrigeration unit 210 can be adjusted by the controller 250. In another embodiment, a full cooling mode for components of the transport refrigeration unit 210 can be controlled by the controller 250. In one embodiment, an economizer circuit can be included in the transport refrigeration unit. In one embodiment, the electronic controller 250 can adjust a flow of coolant supplied to the compressor 218.

Figure 3:
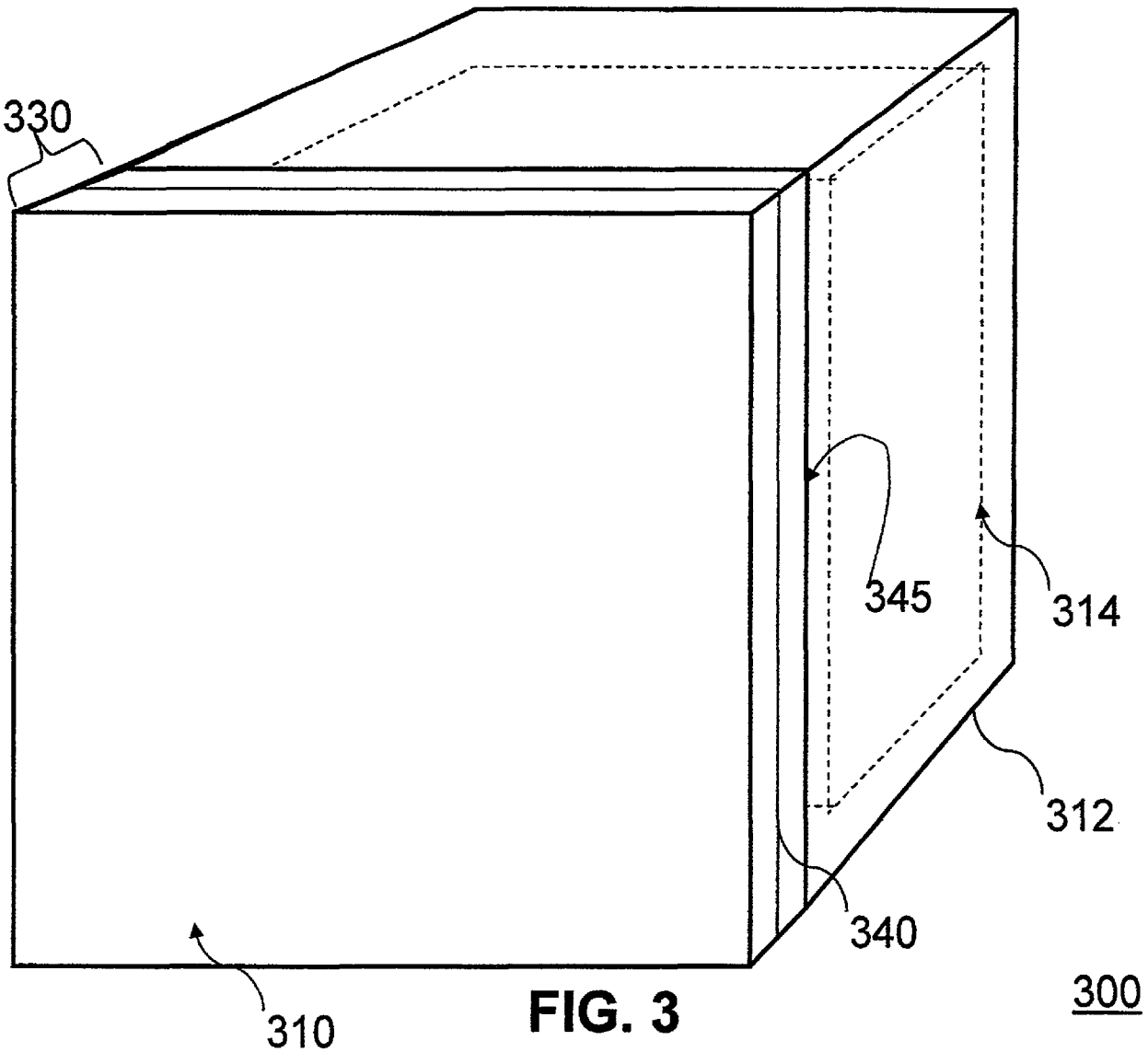
FIG. 3 is a diagram that shows an embodiment of a transport refrigeration system according to the application.

FIG. 3 is a diagram that shows an embodiment of a transport refrigeration system. As shown in FIG. 3, transport refrigeration system 300 can include a transport refrigeration unit 310 coupled to an enclosed space 314 within a container 312. As described herein, the transport refrigeration systems, transport refrigeration modules, components and methods for controlling the same can operate in a cooling mode and a heating mode depending at least in part upon the temperature of the conditioned space and the ambient temperature of the environment outside the enclosed space 314. Air that is cooled or heated by the transport refrigeration system 300 can be drawn by a fan (e.g., blower assembly), conditioned and discharged into the enclosed space 314.

In one embodiment, the transport refrigeration unit 310 can be considered to have a first refrigerated (e.g., conditioned) portion for operative coupling to the enclosed space 314 and a second ambient (e.g., not conditioned) portion that is insulated from the enclosed space 314 (and the first refrigerated portion). For example, an evaporator 326 and evaporator fan 328 can be in the first refrigerated portion and a condenser 322 and a condenser fan 324 can be in the second ambient portion of the transport refrigeration unit 310. A first wall 340 (e.g., physical and/or thermal barrier) can be positioned between the first refrigerated portion and the second ambient portion.

Figure 4A:
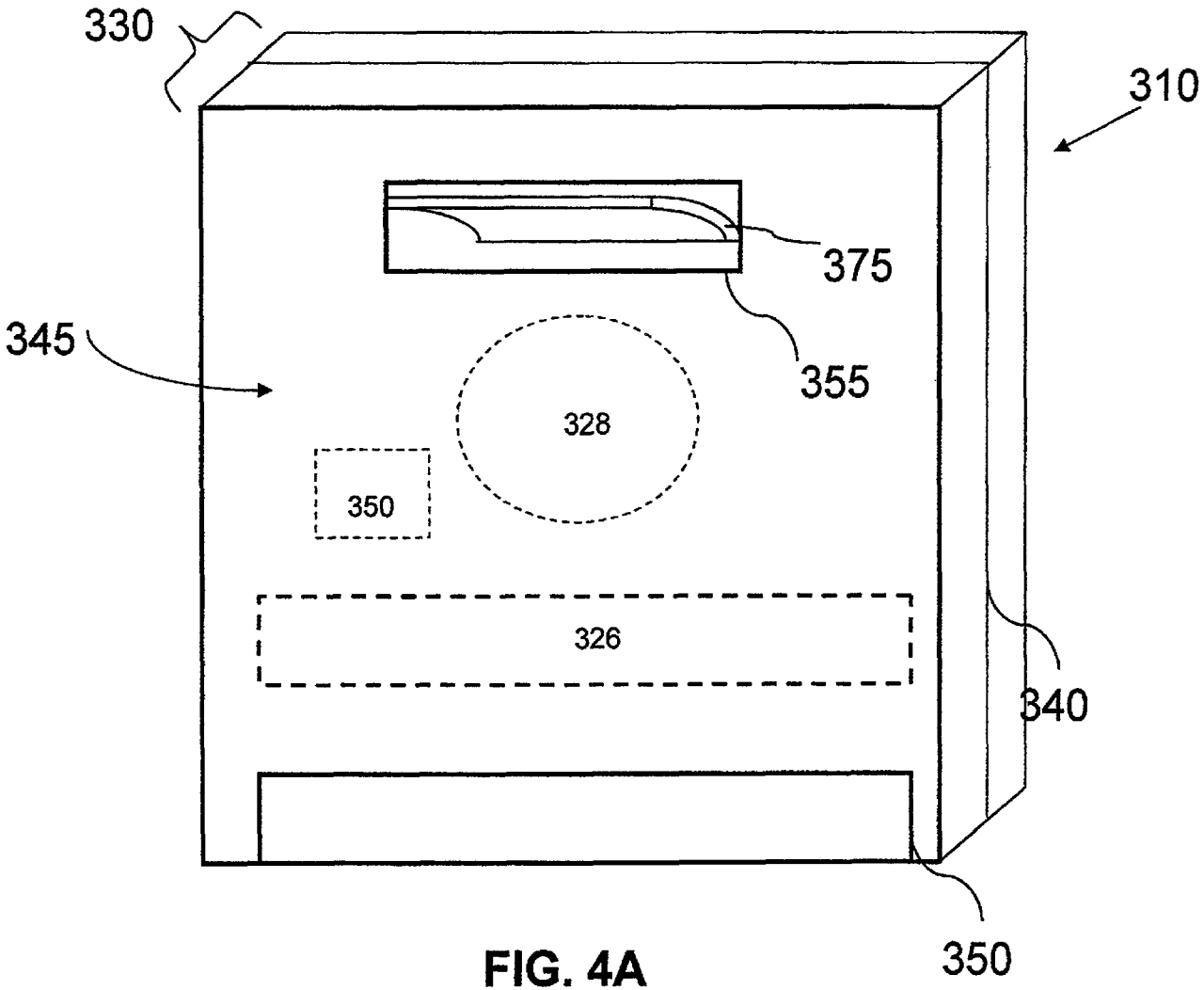
FIG. 4A is a diagram that shows an embodiment of a transport refrigeration system according to the application.
Figure 4B:
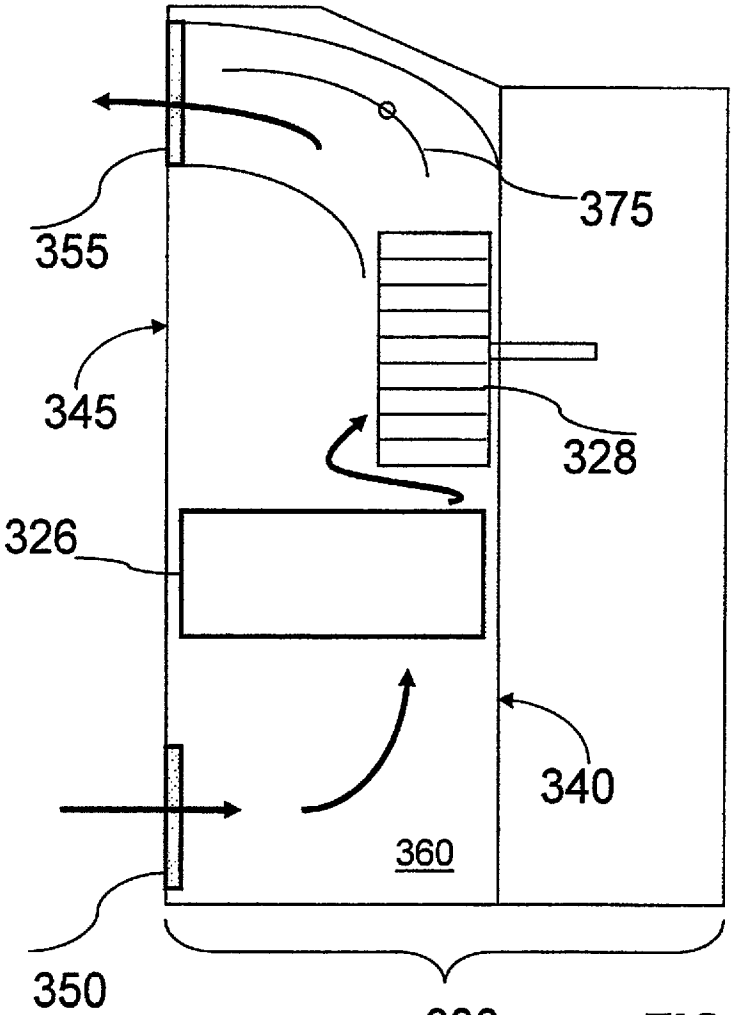
FIG. 4B is a diagram that shows an exemplary schematic cross-sectional view of a portion of FIG. 4A.

As shown in FIGS. 3-4B, the transport refrigeration unit 310 is in communication with the enclosed space 314 via a first opening 350 and a second opening 355 to maintain the enclosed volume 314 at predetermined conditions (e.g., temperature, humidity, etc.) during transportation and storage in order to preserve the quality of the cargo. The first opening 350 and the second opening 355 can be in a first compartment wall 345 configured to face or be operatively coupled to the enclosed space 314. A compartment 330 can enclose the transport refrigeration unit 310. As shown in FIG. 3, the compartment 330 is shown as a rectangular box; however, the exterior shape of the compartment 330 can vary as known to one skilled in the art. Generally, the transport refrigeration unit 310 is operable in a refrigeration mode (e.g., a cooling mode, a heating mode) and a defrost mode, and includes one or more refrigeration components (not entirely shown), such as an evaporator 336, one or more compressors, a condenser, one or more fans, a receiver, and one or more expansion valves to route refrigerant through the transport refrigeration unit 310. Such arrangements are known in the art.

The transport refrigeration system 300 can operate in a defrost mode to limit formation of ice and/or frost in the transport refrigeration unit 310 (e.g., on an evaporator). During operation, exemplary transport refrigeration systems direct heat toward the evaporator 336 in the defrost mode. A warming evaporator 336 can also warm the air around or nearby the evaporator 336 in the defrost mode. For example, relatively warm refrigerant can be directed through the evaporator 336. In some existing transport units, the unit 310 can be operated in reverse such that heat is generated in the evaporator 336 (not the condenser/gas cooler) in a defrost mode. Alternatively, during the defrost mode, heat can be supplied from the condenser 328 to the evaporator 326 (e.g., via configurable ducting). Also, ambient air or a heater can be used to heat the evaporator 336. Further, a resistive device can be co-located with the evaporator 326 such that when power is applied across the resistive device in the defrost mode, heat is supplied to the evaporator 326. Equivalent methodologies and/or apparatus are known to one of ordinary skill in the art to defrost an evaporator in a refrigeration transport unit; and all equivalent methodologies and/or apparatus are consider to fall within the scope of the application.

The compartment 330 can include the first wall 340 that separates components (e.g., condenser 322) of the transport refrigeration unit 310 that remain in an ambient environment mutually exclusive from the enclosed space 314 and/or the first refrigerated portion of the unit 310. The first wall 340 and the first compartment wall 345 can determine a three dimensional passageway 360 (e.g., thermal housing, thermal compartment) therebetween to connect the first opening 350 and the second opening 355. In one embodiment, the first compartment wall 345 determines a front of the passageway 360, the first wall 340 can determine a rear of the passageway 360 and sides of the compartment 330 can determine opposing side walls of the passageway 360 that physically connect the first compartment wall 345 and the first wall 340. However, other configurations can be used to form the passageway 360. For example, inner side portions or walls of the container 312 can be provided as side walls of the passageway 360 or the first wall 340 and/or the first compartment wall 345 can have a three dimensional shape to provide the side walls of the passageway by direct connection therebetween.

The evaporator 326 can be positioned in the passageway 360 behind the first compartment wall 345, and is in communication with the enclosed space 314 through an air flow 352 between the first opening 350 and the second opening 355. In one embodiment, the passageway 360 can sequentially include the evaporator 326 and a damper 375 between the first opening 350 (e.g., return air) and the second opening 355 (e.g., supply air). In one embodiment, the evaporator fan 328 is in the passageway 360 between the evaporator 326 and the damper 375. Alternatively, the evaporator fan 338 can be operably coupled to the passageway 360 anywhere between the first opening 350 and the second opening 355 to move air from the first opening 350 (e.g., from the enclosed space 314), across a surface of the evaporator 326, past the damper 375, and through the second opening 355 (e.g., to the enclosed space 314).

As shown in FIG. 4A, the damper 375 can be placed downstream of the fan 328 to reduce or inhibit heat and/or warm air that is discharged from or moved by the fan 328 during the defrost mode from exiting via the second opening 355 to enter the conditioned space. In one embodiment, the damper 375 is an airtight barrier or a plate that is in an open position when the refrigeration system is in the cooling or heating modes, and is moved to a closed position when the refrigeration system is in the defrost mode. In one embodiment, the damper 375 can pivot or rotate between the open and closed positions about an axis that can be located between a front end and a rear end (e.g., longitudinal) of the damper 375.

Figure 5:
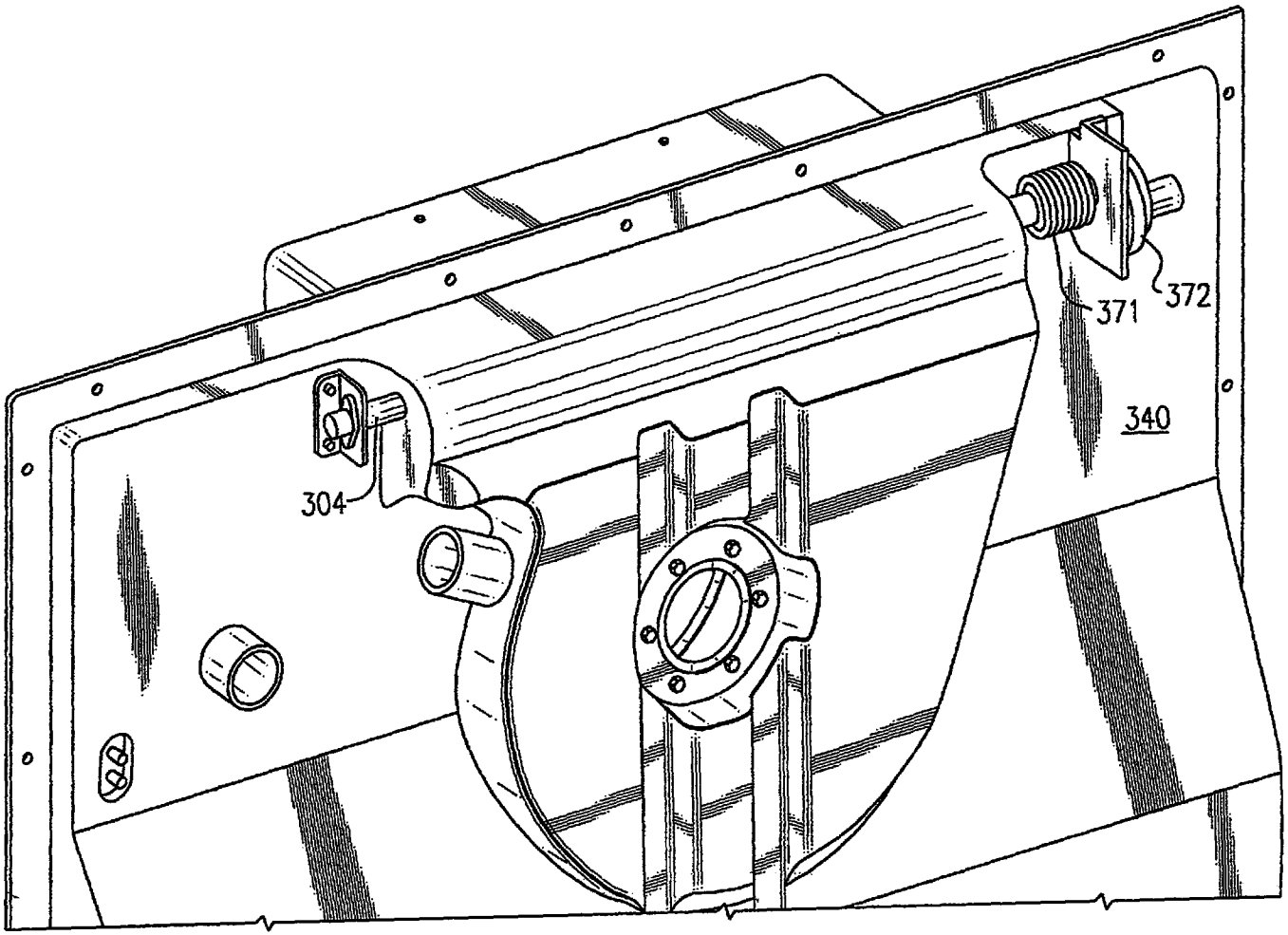
FIG. 5 is a diagram illustrating a perspective disassembled view of a damper according to an embodiment of the application.
Figure 6:
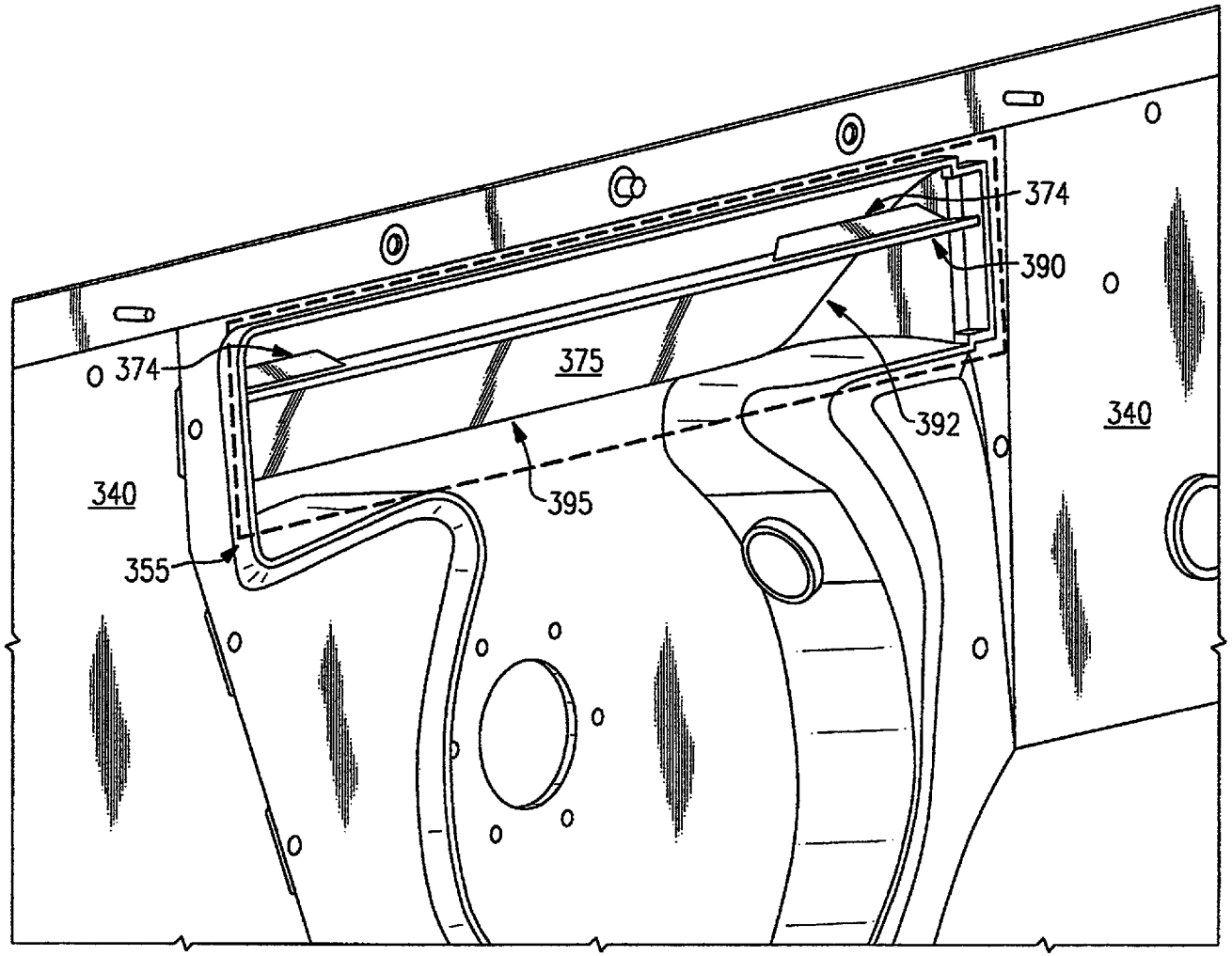
FIG. 6 is a diagram illustrating a perspective disassembled view of a damper according to an embodiment of the application.

FIGS. 5-6 are diagrams that show that the transport refrigeration unit 310 can also include damper assembly 370, which can include a damper actuator 372, a damper support 374, and the damper 375. FIGS. 5 and 6 show that the actuator 372 is behind the first wall 340 in the second ambient portion outside the first refrigerated portion. The damper 375 can be positioned in the passageway 360 in the first refrigerated portion adjacent the second opening 355. The damper actuator 372 is on opposite sides of the first wall 340 from the damper 375.

As illustrated in FIGS. 5-6, the damper support 374 can pass through the first wall 340 to rigidly support opposite ends of the damper 375 in the passageway 360. The actuator 372 is operatively coupled to the damper 375 through the damper support 374 to move the damper 375 between a closed position blocking the second opening 355 and a first position (e.g., open position shown in FIG. 6). Accordingly, the damper support 374 can include any number of linkages, bearings, connectors, fasteners, shafts, cams, etc. to mechanically operatively couple the actuator 372 to the damper 375. The actuator 372 can include any number of devices that can supply force used to move the damper 375 such as but not limited to a linear actuator, mechanism, piston, power train, or a manual operation. In one embodiment, the actuator 372 can be an electrical motor that is in communication with a power source (e.g., battery, etc.) of the transport refrigeration unit 310, although other prime movers are also possible and considered herein. FIGS. 5-6 show an exemplary 3-D shape of the first wall 340.

The damper 375 can be a roughly rectangular shaped when viewed from above/below with a front end 390, opposing sides 392 and a back end 395. In the closed position, the damper 375 can have the front end 390, opposing sides 392 and back end 395 blocking passageway 360 (e.g., the second opening 355). At least one of the front end 390, opposing sides 392 and back end 395 can include resilient seals or the like as known to one skilled in the art to reduce air flow around the damper 375 in the closed position, to make the closed position of the damper 375 airtight and/or to reduce airflow interference in an open position.

As described herein, a transport refrigeration unit 310 can include a damper assembly 370 to operatively block air flow in a defrost mode (e.g., the damper assembly in a first configuration). In one embodiment, a controller 350 of the unit 310 can operate to controllably transition the unit 310 into and/or out of the defrost mode. The damper assembly 370 can include at least one component (the actuator 372 and/or damper support 374) outside the conditioned space (or on an opposite side of the first wall 340) and configured to repeatedly move the damper door from a prescribed position (e.g., closed, open) during one defrost mode. Moving the damper 375 position periodically during defrost or other operational times when ice is likely to build up can reduce the likelihood of the damper 375 freezing in place or freezing in one position. Further, repeatedly moving the damper 375 position during defrost or other operational times when ice can form and can reduce torque requirements of the actuator 372. In one embodiment, repeatedly "jogging" the damper assembly can occur periodically, aperiodically, intermittently, upon operator action or responsive to a sensed condition.

In one embodiment, the damper actuator 372 can comprise a position sensor that can be correlated to determine a position of the damper 375. For example, when the actuator 372 is a motor, the position sensor can be used to determine an angle of rotation of the motor using a potentiometer, optical sensor or the like to generate a signal that can be transmitted to the controller 350. In one embodiment, the actuator 372 can be operated in steps that can be correlated to a plurality of positions between a closed position and an open position of the damper. An exemplary damper can be moved in steps between open and closed or selected prescribed positions. According to embodiments of the application, a damper can be selectively driven (e.g., directly) to one of a plurality of intermediate positions (e.g., 5 positions, 25 positions, 50 positions, or more) between open and closed.

Figure 7:
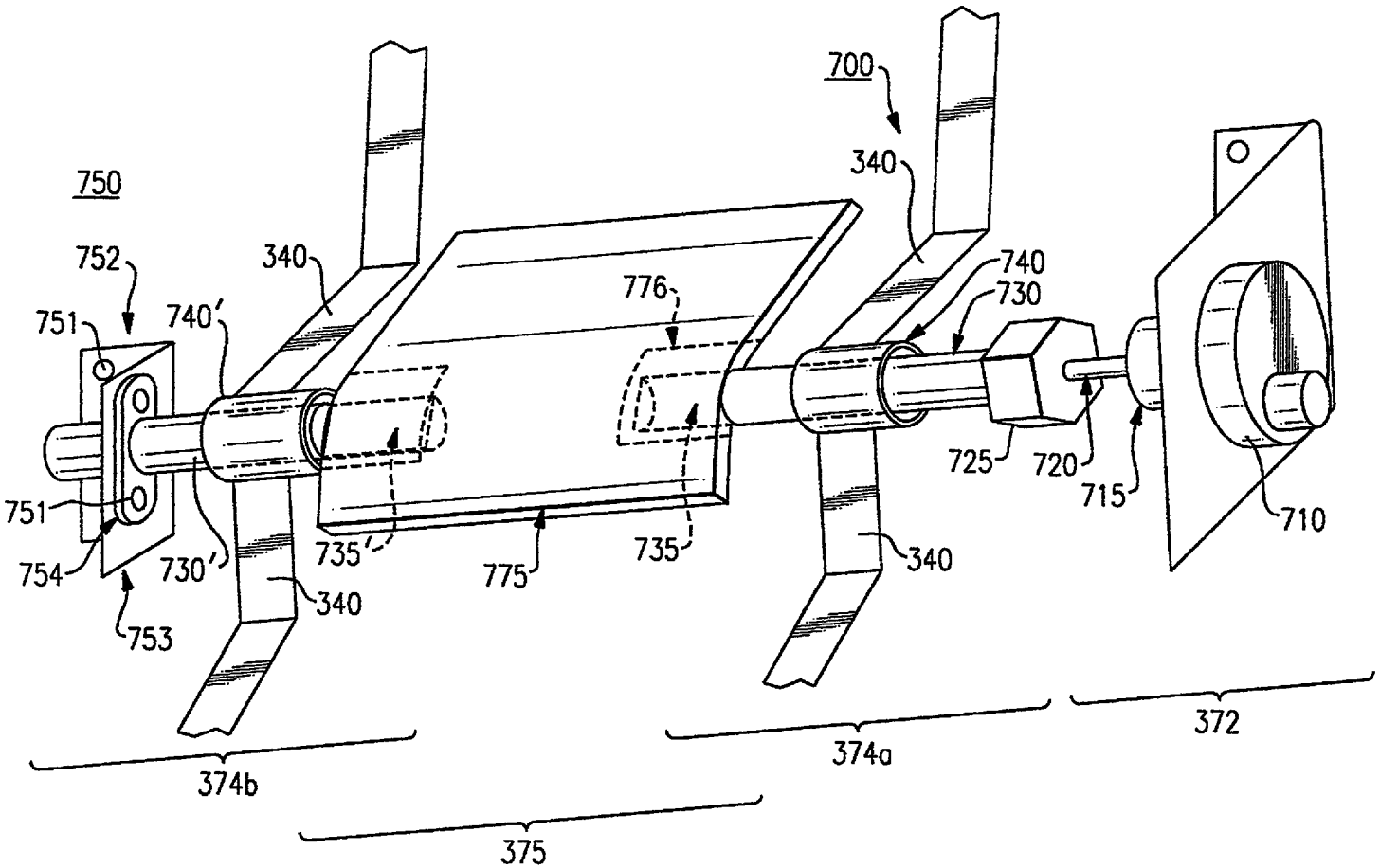
FIG. 7 is a diagram illustrating an exemplary embodiment of a damper assembly according to another embodiment of the application.

FIG. 7 is a diagram that shows an exemplary embodiment of a damper assembly 700 according to the application. The damper assembly 700 can be used as the damper assembly 370; however, embodiments according to the application are not intended to be limited thereto.

As shown in FIG. 7, a damper assembly 700 can include an actuator 710 operatively coupled through support 715 and first shaft 720 to a manual override coupler 725. The first shaft 715 can be driven by and/or be part of the actuator 710. In one embodiment, the actuator 710 functions to move the damper 775 between an open position and a closed position. The manual override coupler 725 connects the first shaft to the damper support shaft 730. The manual override coupler 725 has at least two opposing flat surfaces (e.g., a hex nut configuration) for connection to a wrench (not shown) to provide an additional capability (e.g., a user) to move the damper 775 between the open and closed position. The manual override coupler 725 can allow a limp home capability when the defrost mode of the transport refrigeration system 300 (e.g., actuator 710) is not operational to re-open a closed damper 775. Thus, the damper assembly 700 can provide a manual damper opening or closing operation accessible from the second ambient portion of the compartment 330.

Embodiments of a transport refrigeration unit, damper assembly, and methods for same can provide an ability to service a damper actuator (e.g., replace a motor) without affecting the damper, from the ambient side of the unit 310, without disturbing a loaded cargo, or removing the unit 310 from the container 312. In one embodiment, the actuator can be accessed through a door of the unit 310 or an access panel on the ambient side of the thermal insulation wall or the ambient side of compartment 330. Similarly, a bearing support (e.g., brace 750, shaft 730, 730', etc.) for the damper can be accessed through the ambient side of the unit 310.

The damper support shaft 730 is coupled to the manual override coupler 725 to pass from the ambient side of first wall 340 to the conditioned side of the unit 310 and the passageway 360 in the first refrigerated portion. In the passageway 360, the damper support shaft 730 can form or connect to an attachment portion 735. The attachment portion 735 corresponds to an engagement portion 776 of the damper 775. The attachment portion 735 and the engagement portion 776 of the damper operate to integrally connect to the damper 775 to the damper support shaft 730.

In one embodiment, the damper support shaft 730 can be a cylindrical shaft having a portion removed at the attachment portion 735 to provide a flat engagement surface (e.g., a half-cylinder) and the engagement portion 776 can be glued or affixed to the flat engagement surface. The engagement portion 776 of the damper 775 can include inserts that extend into the damper 775 from one side to the other side of the damper 775 (and/or attachment portion 735) so that the inserts can receive fasteners (e.g., bolts, screws, etc.) that attach the attaching portion 735 to the engagement portion 776 of the damper 775. In embodiments in which the damper 775 is formed by a molding process, the inserts can be co-molded into the damper. Equivalent methodologies are known to one of ordinary skill in the art to couple or rigidly connect the damper 775 and the damper support shaft 730 and all equivalent methodologies are considered to fall within the scope of this application.

The support shaft 730 can directly pass through the first wall 340 or an additional support member 740 can be provided. For example, the additional support member 740 can be a hollow cylinder sized to pass the outer diameter of the damper shaft 730 and function to reduce or eliminate thermal (e.g., conditioned air loss) loss though the hole in the first wall 340 passing the damper support shaft 730. In addition, a gasket (not shown) or the like can be provided between the first wall 340 and the damper support shaft 730, 730'.

As shown in FIG. 7, the damper 775 can be a uniformly thick structure. However, the damper 775 can be tapered or the like. In one embodiment, the damper 775 can be metal; however, other materials having a sufficient rigidity to hold a configuration under the range of air flow pressures through the passageway 360 such as selected plastics, alloys, polymers or the like can be used. Further, the damper 775 is shown as a single unitary piece. However, the damper 775 can be a plurality of separate damper doors provided side-to-side or front-to-back. Alternatively, the damper 775 can be a series of overlapping portions to increase structural support. Equivalent methodologies are known to one of ordinary skill in the art to form the damper 775, and all equivalent methodologies are considered to fall within the scope of the present application.

As shown in FIG. 7, the damper support shaft 730 can include two separate portions 730, 730' rigidly and rotatably connected by the damper 775. After the second portion of the damper support shaft 730' passes from the passageway 360 through the first wall 340 to the second ambient portion, the damper support shaft 730' can be coupled to a brace 750. In one embodiment, the brace 750 includes a bracket having a first portion 752 fixed by fasteners 751 to a support structure, e.g., the first wall 340. The second portion of the damper shaft 730' can be rotatably attached by a brace mount 754 and by fasteners 751 to a second portion 753 of the bracket 750 that is perpendicular to the first portion 752. In one embodiment, the damper support shaft 730, 730' can be provided as a single piece that extends between the engagement portion 776 across the width of the damper 775. The actuator 710 can be mounted to the first wall 340 by a bracket (not labeled). In one embodiment, a second actuator can be drivingly connected to the damper support shaft 730' instead of the brace 750. The brace 750 can be accessed through the second ambient portion (e.g., an access panel in compartment 330) of the unit 310.

Figure 8:
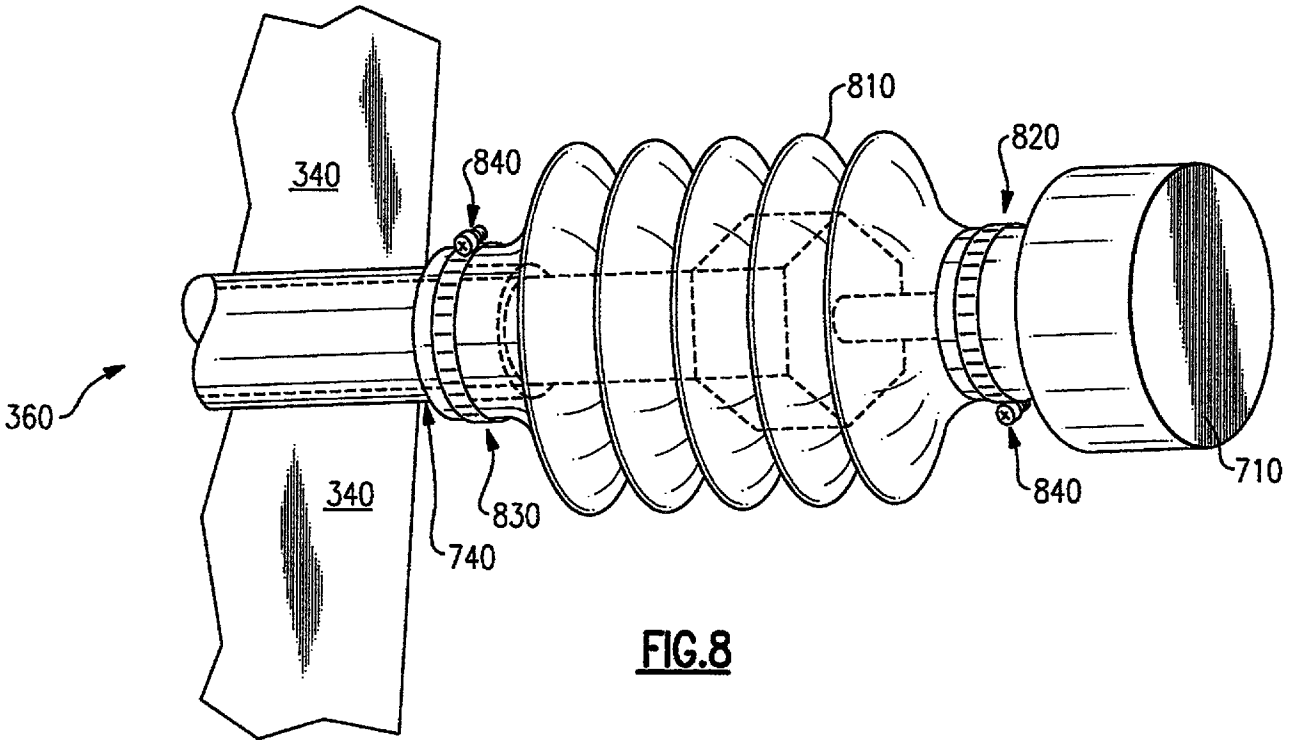
FIG. 8 is a diagram illustrating an exemplary embodiment of a seal for use with the damper assembly of FIG. 7.

FIG. 8 is a diagram that shows an exemplary seal for use with the damper assembly of FIG. 7 according to the application. As shown in FIG. 8, a retractable bellows seal 810 can seal the damper support shaft 730 to the actuator 710. The retractable bellows seal 810 can reduce or prevent air from the enclosed space 314 from escaping through the passageway 360 and the first wall 340 to the second ambient portion in the compartment 330. In one embodiment, the retractable bellows seal 810 is coupled by a first connector 820 to the support member 715 of the actuator 710 and by a second connector 830 to the additional support member 740. The first connector 820 and second connector 830 can be a tightnable adjustment band having a circumference reduced by a corresponding tangential screw 840. However, other fasteners as known to one skilled in the art may be used to connect the bellows seal 810 between the actuator 710 and the first wall 340. To access and operate the manual operation coupler 725, one end of the retractable bellow seal 810 is released and slid over the coupler 725. Then, manual force can be applied to open or shut the damper 775 (e.g., when the actuator 710 is not operational).

Figure 9:
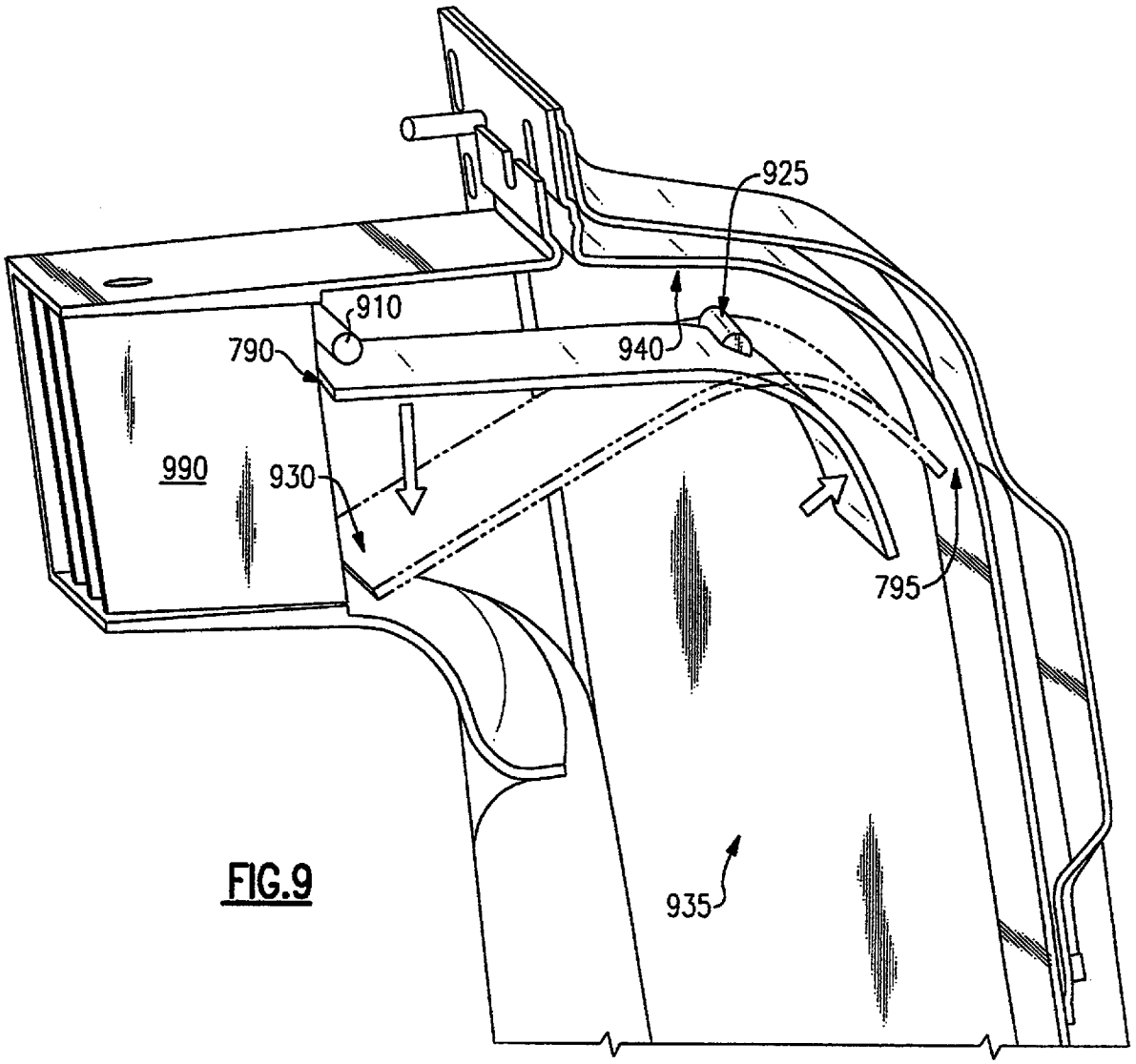
FIG. 9 is a diagram illustrating a cross-sectional view of a damper according to an embodiment of the application.

FIG. 9 is a diagram illustrating a perspective cross-sectional view of a damper according to embodiment of the application. As shown in FIG. 9, the damper shaft 730 can define a pivot axis 925 so that the damper 775 is pivotable about the pivot axis 925 between the open position and the closed position. As shown in FIGS. 7 and 9, the pivot axis 925 is offset from a center of the damper 775 between the first end 790 and the second end 795. In one embodiment, the second end 795 is closer to the pivot axis 928 than the first end 790. The axis 925 can be vertically offset so that when the damper 775 is in the closed position, the first end 790 can be engaged with the lower surface of the passageway 360 and the second end 795 can be engaged with an upper surface of the passageway 360.

In one embodiment, the open position of the damper 775 can be controlled by the actuator 710 moving the damper 775 until physically blocked by at least one stop member 910. As shown in FIG. 9, in a portion of the passageway 360 surrounding the damper 775 can include an upper surface 940, lower surface 930 and opposing side surface 935 that encompass the air flow 352. The stop members 910 are coupled to the side surface 935. However, the stop members 910 can be configured to extend from or mount to the upper surface 940 or the lower surface 930. Each stop member 910 extends inward from the corresponding side surface 935, and is spaced apart from the upper surface 940 so that when the damper 775 is in the open position, the damper 775 extends approximately parallel to the upper surface 940 (that can be sloped, curved, non-linear, etc.) to direct the airflow from the evaporator fan efficiently through the second opening 355. In one embodiment, the stop members 910 can be spaced apart from the upper wall portion 940 so that when the damper 775 is in the open position, the damper 775 extends slightly downward away from or slightly upward toward the upper surface 940.

In one embodiment, a duct unit 990 can be positioned between the damper 775 and the second opening 355 in the passageway 360 to controllably direct conditioned air out of the second opening 355 and/or into the enclosed space 314.

In operation, the evaporator fan 328 generates the airflow 352 through the passageway 360 and into the enclosed space 314 when the transport refrigeration unit 310 is in the refrigeration mode. Generally, air from the conditioned space enters the passageway 360 from the enclosed space through the first opening 350 and is conditioned by the evaporator 322, and the airflow 352 is discharged by the evaporator fan 328 toward the second opening 355. The airflow 352 flows outward from the evaporator fan 328 across the damper 775 toward the second opening 355.

In some embodiments the evaporator fan 328 rotates continuously when the transport refrigeration unit 310 (e.g., condenser 318) is operating, thereby continuously generating the airflow 352. When the transport refrigeration unit 310 is in the defrost mode, the warm, defrosting evaporator 322 can heat air that passes over the evaporator fan 328. The damper 775 is pivoted to the closed position when the transport refrigeration system 300 is in the defrost mode to inhibit flow of the heated airflow from the evaporator fan 328 into enclosed space 314. In one embodiment, a front end or first end of the damper can contact the upper surface and the opposite end or second end can contact the bottom surface when the damper is in the closed position and sides of the damper 775 contact sides of the passageway 360 to more completely reduce air flow. As a result, the airflow generated by the evaporator fan 328 circulates within the passageway 360 between the first wall 340 and the compartment wall 345 generally around the perimeter of evaporator fan 328 and does not pass through the second opening 355 (or the first opening 350) into the enclosed space 314.

Embodiments of apparatus and/or methods according to the application can be located in a conditioned air flow without interfering with and/or impeding fan efficiency. In one embodiment, exemplary dampers can be located adjacent or at an outlet opening to the conditioned or cargo space. Locating these dampers in the exhaust duct takes up additional space in the passageway. Embodiments of apparatus and/or methods according to the application do not affect a size of one or more components of the refrigeration system (e.g., components in the conditioned air flow, evaporator coil, compressor, etc.) and/or a refrigeration capacity of the refrigeration system.

Embodiments of the application have been described herein with reference to a single passageway between a return air vent and a supply air vent. However, any number of first openings and second openings may be used. Further, any number of sub-passageways, associated ducts, vias can be used to form the passageway 360. Similarly, the air flow 352 can be provided between a plurality of first openings 350 and a plurality of second openings 355 such the air flow 352 engages the evaporator therebetween and can be block by one or more corresponding damper assemblies described herein.

Embodiments of apparatus and/or methods according to the application can reduce or prevent air that is warmed by the evaporator in the defrost mode from reaching the temperature controlled cargo that can expose the temperature sensitive cargo to adverse or undesirable conditions.

However, various cross-sections (e.g. tapered, non-liner) and shapes (e.g., rectangular) of the damper 375 can be used.

Figure 10A:
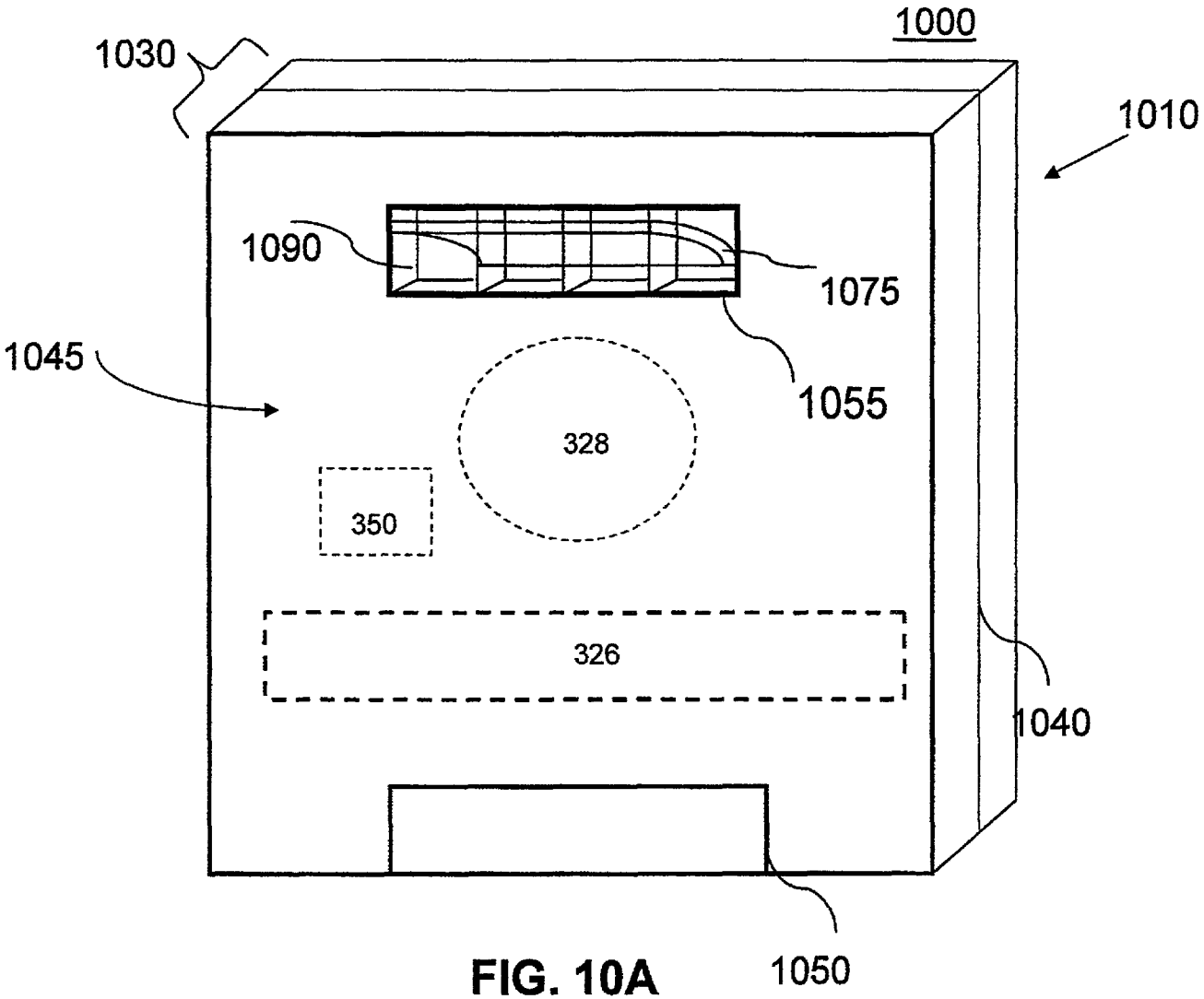
FIGS. 10A-10B are diagrams illustrating an embodiment of a damper assembly for a transport refrigeration system according to the application.
Figure 10B:
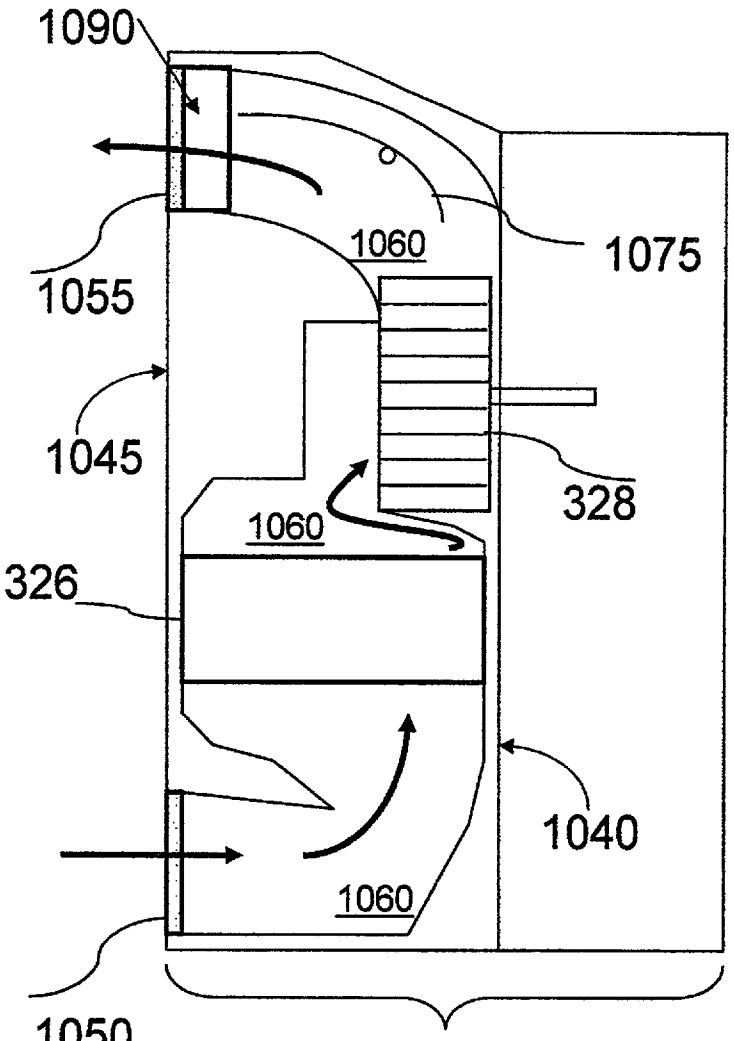

FIGS. 10A-10B are diagrams that show another embodiment of a damper assembly and a transport refrigeration system according to the application. As shown in FIGS. 10A-10B, transport refrigeration system 1000 can include a transport refrigeration unit 1010 to couple to an enclosed space 314 within a container 312. A thermal barrier 1040 (e.g., physical barrier) can be positioned between a first refrigerated portion operatively coupled to the enclosed space 314 and a second ambient portion of the transport refrigeration unit 1010.

As shown in FIGS. 10A-10B, the transport refrigeration unit 1010 can be in communication with the enclosed space 314 via a first opening 1050 and a second opening 1055 to maintain the enclosed volume 314 at predetermined conditions (e.g., temperature, humidity, etc.) during transportation and storage in order to preserve the quality of the cargo. The first opening 1050 and the second opening 1055 can be in a first compartment wall 1045 configured to face or be operatively coupled to the enclosed space 314. Generally, the transport refrigeration unit 1010 is operable in a refrigeration mode (e.g., a cooling mode, a heating mode) and a defrost mode, and includes one or more refrigeration components (not entirely shown), such as an evaporator 326, one or more compressors, a condenser, one or more fans, such as evaporator fan 328 and one or more expansion valves and a controller such as controller 350 to route refrigerant through the transport refrigeration unit 1010. Such arrangements are known in the art.

A compartment 1030 enclosing the transportation refrigeration unit 1010 can include the thermal barrier 1040 that separates components (e.g., condenser 322) of the transport refrigeration unit 1010 that remain in an ambient environment from the enclosed space 314 and/or the first refrigerated portion of the compartment 1030 or the unit 1010. The thermal barrier 1040 and the first wall 1045 can determine a three dimensional passageway 1060 (e.g., housing, duct(s), thermal compartment) therebetween to connect the first opening 1050 and the second opening 1055. In one embodiment, the first compartment wall 1045 determines a front of the passageway 1060, the thermal barrier 1040 can determine both a rear of the passageway 1060 and opposing side walls of the passageway 1060 that physically interconnect the first wall 1045 and the thermal barrier 1040. However, other configurations can be used to form the passageway 1060.

The evaporator 326 can be positioned in the passageway 1060 behind the first wall 1045, and is in communication with the enclosed space 314 through an air flow 1052 between the first opening 1050 and the second opening 1055. In one embodiment, the passageway includes directional ducts 1090 (e.g., adjacent and inside the second opening 1055 and inside the container 312). In one embodiment, the passageway 1060 can sequentially include the evaporator 326 and a damper 1075 along the passageway 1060. The evaporator fan 338 can be operably coupled to the passageway 1060 anywhere between the first opening 1050 and the second opening 1055 to move air from the first opening 1050 (e.g., from the enclosed space 314), across a surface of the evaporator 326, past the damper 1075, and through the second opening 1055 (e.g., to the enclosed space 314).

In one embodiment, the damper 1075 is positioned adjacent the first opening 1050 or second opening 1055 and outside the compartment 1010. In such a configuration, the damper 1075 can be mounted to the outside of the compartment 1010. Alternatively, the damper 1075 can be in the passageway 1060 between the first opening 1050 and the evaporator 328, adjacent and after the evaporator 328 (e.g., between the evaporator 328 and the evaporator fan 338), adjacent and after the evaporator fan 338 or between the directional ducts 1090 and the second opening 1055. Regardless of the position in the passageway 1060 of the damper 1075, an actuator 1072 to move the damper 1075 (e.g., between at least three different positions) can be co-located in the refrigerated portion of the compartment 1010 (e.g., in the passageway 1060) or operatively coupled to the damper and positioned in the second ambient position of the compartment 1010. Regardless of the location of the actuator 1072, an exemplary damper 1075 can be placed upstream or downstream of the evaporator fan 338.

As shown in FIGS. 10A-10B, an exemplary position of the damper 1075 can be downstream of the evaporator fan 338 adjacent the first opening and inside the compartment 1010, to reduce or inhibit heat and/or warm air that is discharged from or moved by the fan 338 during the defrost mode from exiting via the second opening 1055 to enter the conditioned space. In one embodiment, the damper 1075 is a barrier that is in an open position when the refrigeration system is in the cooling or heating modes, and is moved to a closed position when the refrigeration system is in the defrost mode.

In one embodiment, the damper 1075 can be positioned in a plurality of intermediate positions between an open position (e.g., first position) and a closed portion (e.g., second position). Accordingly, in one embodiment the damper 1075 may include three (3) intermediate positions, seven (7) intermediate positions, 25 intermediate positions or more than 75 intermediate positions or the like. Intermediate positions of the damper 1075 can be used in an operational mode or cooling mode of the transport refrigeration unit 1010. In one embodiment, intermediate positions can be used to adjust the air flow volume or air speed between a high level, first prescribed level, or a 100% level air flow, and a low level, second prescribed level or a 0% air flow.

At least one intermediate position, a plurality of intermediate positions, or all intermediate positions of the damper 1075 can be correlated to an air flow level. For example, such a correlation can be determined empirically. In one embodiment, the intermediate positions of the damper 1075 can be correlated to the transport refrigeration unit 1010 modes, operations or capacity (e.g., cooling capacity).

The damper 1075 can be moved (e.g., reciprocally) between a plurality of intermediate positions using the actuator 1072. The actuator 1072 can be a gear motor, stepper motor, DC motor, electric motor, mechanical assembly, or the like operatively connected to the damper 1075. The actuator 1072 can be positioned in anywhere in the container 1030. For example, the actuator can be positioned in the first refrigerated position (e.g., passageway 1060) or the second ambient portion of the container 1030.

In one embodiment, the damper 1075 can be periodically moved to a known or prescribed position (e.g., closed) and then stepped to a current desired position. In this example, should the damper 1075 include nine (9) equally spaced intermediate positions, driving the actuator 1072 ten (10) steps in a single direction toward the closed position can move the damper 1075 from an open position and to the closed position. Similarly, driving the damper 1075, five steps away from the closed position would position the damper 50% open.

However, embodiments of the damper are not intended to be so limited. For example, intermediate positions can be unequally spaced. In one embodiment, a prescribed function or nonlinear function can determine the intermediate positions. In one embodiment, a plurality of intermediate portions between the open and closed positions of the damper 1075 can each use different step sizes (e.g., equal step sizes) such as step sizes a, b, c, respectively, where a>b>c or a<b<c.

In one embodiment, the majority of intermediate positions can be located in one portion or section (e.g., 30%, 20%, 10%) of the distance between the open and closed positions. In one embodiment any position or intermediate position of the damper 1075 can be directly reached (e.g., in one driving action of the actuator 1072). Further, the actuator 1072 can operate using a plurality of speeds.

In one embodiment, a current position of a controlled variable positioned damper 1075 according to embodiments of the application can be controlled by or have its position reported (e.g., continuously) to a controller 350. One or more sensors can be operatively coupled to the damper 1075 and the controller 1050 in order to determine a position thereof. The sensor can be used to determine which one of a plurality of operating positions (e.g., open, intermediate, closed) the damper 1075 is occupying. In one embodiment, the sensor can be physically coupled to the damper 1075 and wirelessly connected to the controller 350.

Figure 11:
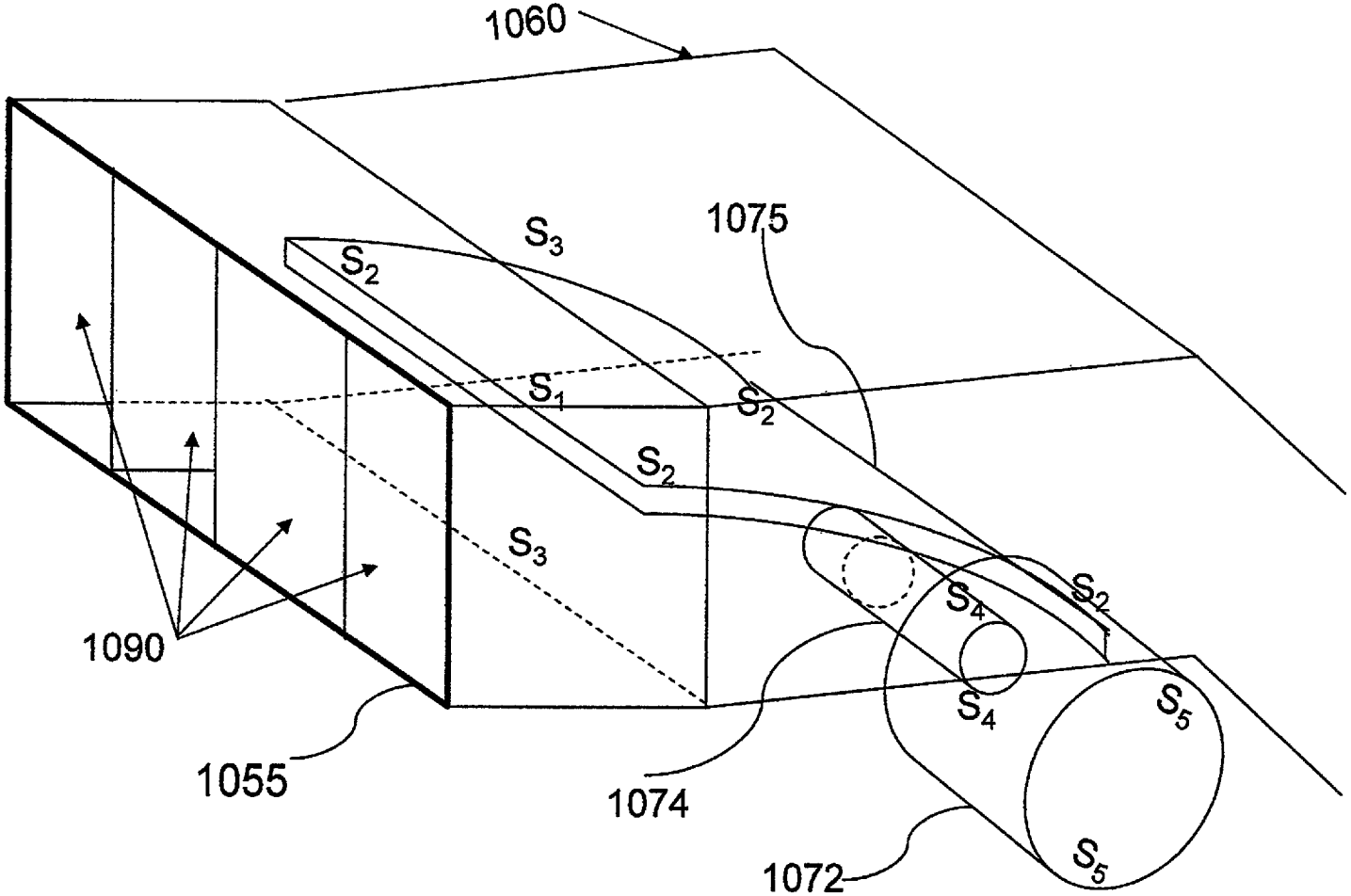
FIG. 11 is a diagram that shows an exemplary representative sensor for use with a damper assembly according to embodiments of the application.

As shown in FIG. 11, in one embodiment a sensor 51 coupled to the damper 1075 can be used to determine its position (e.g., among a plurality or set of open positions and a closed position). For example, one or more sensors 51 can be used to determine a position of a front edge of the damper 1075. Alternatively, a plurality of sensors S2 can be used to compare one or more relative positions of a front edge (e.g., corners) and a rear edge (e.g., corners) of the damper 1075.

In one embodiment, a sensor S3 can be positioned on a corresponding location in the passageway 1060 and used with the sensor 51 or sensors S2 to determine a current occupied position (e.g., intermediate position) of the damper 1075. For example, the sensor S3 can be located on a top surface or a bottom surface of the passageway 1060 surrounding the damper 1075. Alternatively, the sensor S3 can be mounted rigidly in a spaced relationship to the damper 1075 within the compartment 1030.

In one embodiment, a linkage between the actuator 1072 and the damper 1075 can be used to determine a position of the damper 1075. For example, a sensor S4 mounted on a rotating damper shaft (e.g., 730, 730') can be used to determine an amount of rotation of the linkage, which can be correlated to a position of the damper 1075, to determine the current position of the damper 1075. However, the exemplary linkage between the actuator 1072 and the damper 1075 can include any number of bearings, connectors, fasteners, shafts, cams, etc. to mechanically operatively couple the actuator 1072 to the damper 1075, each of which can be monitored by the sensor S4.

In one embodiment, the sensor S5 can be mounted to the actuator 1072. As described herein, the actuator 1072 can include a motor, solenoid, cam, an electric motor, a linear actuator, mechanism, piston, power train, or a manual operation. For example, the sensor S5 can be mounted to determine a relative rotational or linear movement of the actuator 1072 that can be correlated to a movement amount of the damper 1075 to identify a current position within the plurality of positions (e.g., within a first set of three or more positions) of the damper 1075. Alternatively, a physical position of the sensor S5 can be used to determine the current position of the damper 1075. According to embodiments of the application, a position of the damper 1075 can be determined (directly or indirectly) from sensors that detect movement or a position of the damper 1075 that are operatively coupled to the controller 350.

In one embodiment, a plurality of damper units can be implemented in each of a plurality of ducts such as the directional ducts 1090. In such a configuration (and other configurations), damper units can control or modify air flow direction in combination with air flow amounts. For example, 4 to 8 individual directional ducts 1090 can be implemented just inside and adjacent the second opening 1055. However, the number of directional ducts 1090 can be more or fewer. In such a configuration, a single actuator can be connected to drive all the damper units in unison between each of an open position, a plurality of intermediate positions and a closed position. Alternatively, two separate actuators can be selectively connected to corresponding adjacent halves of the damper units in the ducts 1090 or connected respectively to horizontally alternating damper units in the directional ducts 1090. Alternatively, each damper unit can use a single corresponding actuator unit and sensor S6.

In one embodiment, the damper 1075 can be located adjacent both the first opening 1050 and the second opening 1055, and positioned to be driven by a single actuator or support shaft (not shown). For example, the damper 1075 can include a plurality of horizontal louvers connected together to extend from a top to a bottom (e.g., to cover) of the first and second openings. A single driving shaft can operate the plurality of louvers to move among at least one intermediate position, an open position, and a closed position. In such an embodiment, the damper 1075 can be mounted to an outside or inside surface of the compartment 1010. The linkage having the sensor S4 has a prescribed relationship to the damper position or can be rigidly connected to the damper 1075.

As described herein, in some embodiments of a damper assembly, transport refrigeration units using the same, and methods for operating a transport refrigeration system can provide a controllable variable position damper. In one embodiment, a damper position can be correlated to a transport refrigeration system capacity or a component capacity therein.

In one embodiment, the controller 350 can correlate position of damper (e.g., damper 775, damper 1075) to air flow reduction. For example, a 100% open damper can provide a 100% system air flow, and a closed damper can provide a 0% system air flow. Each intermediate position of the damper 1075 can be correlated to a corresponding air flow between 0-100%. In one embodiment, a prescribed relationship between air flow and damper position can be determined empirically, for example, for a component (e.g., evaporator fan) or a mode of the transport refrigeration unit 1010. Accordingly, a 25% open damper may result in 50% air flow.

Further, in one embodiment, an evaporator fan 1038 can operate in a low speed and a high speed. These exemplary speeds can be combined with a plurality of intermediate damper positions of the damper 1075 to rapidly increase a controllable variability of air flow in the transport refrigeration unit 1010 according to embodiments of the application. In one embodiment, the controller 350 can operate the damper position to provide better approximation of capacity of the transport refrigeration unit 1010 (e.g., to cargo). For example, a cargo may slowly warm when operating the evaporator fan 338 at a low speed and the cargo may cool below a required or desired temperature when operating the evaporator fan 338 at a high fan speed. The controller 1050 can continuously provide a required temperature using embodiments of the application to operate the evaporator fan 1038 on high speed and operate the damper 1075 at an intermediate position. Accordingly, the quality of the delivered cargo can be increased (e.g., by avoiding cycling the transport refrigeration unit 1010 to capacities above and below a prescribed capacity correlated to a current cargo).

In one embodiment, the controller 350 can operate a damper position of the damper 1075 to provide increased variability of system capacity or granularity of system capacity. For example, in one embodiment according to embodiments of the application, the evaporator fan 1038 can operate at either low speed or high speed, however, movement of the damper between a plurality of intermediate positions can provide system cooling capacities between a corresponding low evaporator fan speed capacity and a corresponding high evaporator fan speed capacity (e.g., within a respective operational mode of the transport refrigeration unit 1010).

In one embodiment, a compressor (e.g., compressor 318) can operate using more than one compressor capacity, which can affect a transport refrigeration unit 1010 capacity. For example, when an exemplary compressor has two speeds and can operate with two unloaders, the exemplary compressor can provide system 1000 or controller 350 with four (e.g., more than two compressor capacities) compressor capacities. To better match the variable state of the compressor capacity, the damper 1075 position may be correlated and/or modified. Thus, movement of the damper 1075 between a prescribed set of positions including a plurality of intermediate positions can to provide system cooling capacities better matched to compressor operations (e.g., within a respective operational mode of the transport refrigeration unit 1010).

In one embodiment, adjusting a damper position of the damper 1075 among variably open positions can allow an additional independent adjustment for humidity. For example, the damper 1075 position can be moved (e.g., away from fully open toward closed) to adjust (e.g., slow) the airflow across the evaporator 326 to adjust humidity (e.g., decrease humidity to more rapidly dry a cargo). Similarly, a system 1000 capacity can be correlated to a prescribed cargo or container size. Thus, intermediate damper positions can be used to adjust capacity to cargo or trailer size. For example, a high speed fan may be correlated to a 53' container. However, alternate container sizes or smaller cargo load may use reduced "cooling capacity" (e.g., speed across the evaporator 326) using embodiments of damper assemblies, transport refrigeration units and methods for same according to the application.

In one embodiment, confirmation of the correct operation of the damper 775 can be determined using a back-up detection of the damper position. For example, the existing return air temperature (RAT) and supply air temperature (SAT) can be used as a backup to the sensor (e.g., sensors S1-S6) to indicate/confirm damper opening or closing. In one embodiment, RAT>SAT can be used as a back-up determination that the damper 1075 is open and RAT approximately equal to SAT (e.g., (RAT−SAT)<threshold) can confirm or determine the damper 1075 is closed. In one embodiment, in a defrost mode SAT<<RAT can indicate the damper 1075 is open. Further, in the defrost mode, the temperature relationship of SAT, RAT can vary according to a position of the damper 1075 to the SAT, and/or the RAT. For example, the SAT can be determined (e.g., sensors mounted along the passageway 1060) before or after the closed damper 1075 in the defrost mode. The information regarding the damper 1075 being in the closed/intermediate/open position can be provided to the controller 1050 and/or operator.

Embodiments of the application have been described herein with reference to controlling air flow or transport refrigeration system capacities. However, embodiments of the application are not intended to be limited thereby. For example, embodiments of the application can control air directional flow, for example by having a front sealing surface of the damper be against a top, sides or bottom surface of the passageway or directional ducts and/or by use of a shape of the damper.

Embodiments of the application have been described herein with reference to a single damper or damper door. However, embodiments of the application are not intended to be so limited. For example, embodiment of the application may be configured to use two or more vertically spaced dampers or damper doors (e.g., in a fixed prescribed spatial relationship).

Embodiments of the application have been described herein with reference to a heat evaporation type heat exchanger. However, embodiments of the application are not intended to be so limited. For example, embodiment of the application may be configured to use a heat absorption type heat exchanger. Embodiments of the application can improve transport conditions for transport refrigeration modules and methods thereof relative to a fixed length economy mode.

In one embodiment of the transport refrigeration unit 10 (e.g., as shown in FIG. 2), the condenser fan 224 can be replaced by a first circulating fluid heat exchanger and the evaporator fan 228 can be replaced by a second circulating fluid heat exchanger. The first circulating fluid heat exchanger can be thermally coupled to the condenser heat exchanger unit 222 to remove heat from the coolant and transfer the heat to a second circulating fluid. The second circulating fluid heat exchanger can be thermally coupled to the evaporator heat exchange unit 226 to transfer heat from a third circulating fluid within the second circulating fluid heat exchanger to the coolant within the evaporator heat exchange unit 226.

The first wall 340 can be insulated and can include a single layer or a plurality of layers (e.g., co-joined). The first wall 340 can include a physical layer to prevent the flow of conditioned air therethrough. Further, the first wall 340 can have a three dimensional (3D) shape to reduce an overall size of the unit 310. The first wall 340 can include a thermal layer or provide a thermal barrier between an ambient portion of the unit 310 that is not conditioned and the portion of the unit 310 to be conditioned, which is not accessible without removing the cargo load in the container 314 or detaching the unit 310 from the container 314.

The container 12 illustrated in FIG. 1 may be towed by a semi-truck for road transport. However, those having ordinary skill in the art will appreciate that exemplary containers according to embodiments of the application is not limited to such trailers and may encompass, by way of example only and not by way of limitation, trailers adapted for piggy-back use, railroad cars, and container bodies contemplated for land and sea service.

Components of the transport refrigeration unit (e.g., motors, fans, sensors), as known to one skilled in the art, can communicate with a controller (e.g., transport refrigeration unit 10) through wire or wireless communications. For example, wireless communications can include one or more radio transceivers such as one or more of 802.11 radio transceiver, Bluetooth radio transceiver, GSM/GPS radio transceiver or WIMAX (802.16) radio transceiver. Information collected by sensor and components can be used as input parameters for a controller to control various components in transport refrigeration systems. In one embodiment, sensors may monitor additional criteria such as humidity, species concentration or the like in the container.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment. For example, features and/or aspects of embodiments described with respect to FIGS. 10A-11 can be used, combined with, or replace aspects and/or features of embodiments described with respect to FIG. 3, FIGS. 4A-4B, or FIGS. 7-8.

We claim:

1. A transport refrigeration unit including a compressor, a primary refrigerant circuit including heat rejection heat exchanger downstream of said compressor, and a heat absorption heat exchanger downstream of said heat rejection heat exchanger, the transport refrigeration unit comprising:

a barrier to separate a first portion of the transport refrigeration unit to operate in a refrigerated environment from a second portion;

at least one damper door in the refrigerated portion, the damper door to move between three or more positions; and an actuator operatively coupled to move the damper door, the actuator controlling movement of the damper door between an open position and a closed position and a plurality of intermediate positions between the open position and a closed position;

where the plurality of intermediate positions of the damper door are configured to vary a transport refrigeration unit capacity or a transport refrigeration unit humidity capacity.

2. The transport refrigeration unit of claim 1, where the damper door can be sequentially reciprocally moved between the closed position and the plurality of intermediate positions or directly moved to the closed position and each of the plurality of intermediate positions.

3. The transport refrigeration unit of claim 2, where the plurality of intermediate positions are equally spaced, spaced in two or more different linear sections, spaced with changing granularity, non-linearly spaced, spaced without intermediate positions, spaced without repeatable intermediate positions or spaced having a prescribed relationship.

4. The transport refrigeration unit of claim 1, comprising at least one sensor on the damper door or the actuator.

5. The transport refrigeration unit of claim 1, comprising at least one sensor operatively coupled to provide a current stepped position of the damper door away from a first position.

6. The transport refrigeration unit of claim 5, wherein said at least one sensor comprises first sensor units positioned on the actuator, on a support structure of the damper door, on a support shaft of the damper door, on an internal wall of the transport refrigeration unit, in an air conduit of the transport refrigeration unit, in a passageway enclosing the damper door, or on the damper door, second sensor units operatively proximate to corresponding first sensor units.

7. The transport refrigeration unit of claim 6, comprising second sensor units operatively proximate to corresponding first sensor units where the first and second sensor units are wireless or wired and connected to a controller, the controller is configured to operate the transport refrigeration unit.

8. The transport refrigeration unit of claim 1, comprising:

a passageway to operate in the refrigerated environment between a first opening and a second opening; and the heat absorption heat exchanger in the passageway, where the damper door is coupled to the first opening, between the first opening and the heat absorption heat exchanger between the heat absorption heat exchanger and the second opening or coupled to the second opening.

9. The transport refrigeration unit of claim 1, where the actuator comprises a motor, solenoid, cam, an electric motor, a linear actuator, mechanism, piston, power train, or a manual operation, and where a supply air temperature and a return air temperature are used to determine a closed damper door position or an open damper door position.

10. The transport refrigeration unit of claim 1, where the plurality of intermediate positions of the damper door provides a corresponding variation in air flow.

11. The transport refrigeration unit of claim 1, where the plurality of intermediate positions of the damper door are used to vary system capacity in combination with at least one of fan units, compressor units, cargo type, cargo size, container size, economizer units, or system operational models.

12. A transport refrigeration unit comprising:

an evaporator connected within the transport refrigeration unit;

a damper configured to selectively vary a prescribed air flow in communication with the evaporator;

at least one sensor operatively coupled to the damper;

a controller coupled to the sensor to determine when the damper is in an open position, a closed position and plurality of intermediate positions between the open position and a closed position; and a damper actuator operatively coupled to the damper, the damper actuator to move the damper to the open position, the closed position and the plurality of intermediate positions between the open position and a closed position;

the controller selecting one of the plurality of intermediate positions of the damper to vary a transport refrigeration unit capacity or a transport refrigeration unit humidity capacity.

13. The transport refrigeration unit of claim 12, comprising:

a passageway including an inlet for communication with a first portion to be conditioned and an outlet for communication with the first portion to be conditioned;

a blower assembly disposed in communication with the inlet and the outlet, the blower assembly configured to generate an airflow from the inlet toward the outlet; and at least one damper blade to controllably vary the air flow.

14. The transport refrigeration unit of claim 13, wherein the damper actuator comprises a motor coupled to a shaft and configured to pivot the damper blade between the open position and the closed position, wherein the transport refrigeration unit includes a refrigeration mode and a defrost mode, and wherein the damper blade is pivoted to one of said open position and one of the plurality of intermediate positions to direct air through the outlet in response to the refrigeration mode, wherein the damper blade is pivoted to the closed position to inhibit air from flowing through the outlet in response to the defrost mode, wherein a first end of the damper blade contacts an upper portion of the passageway and a second end of the damper blade contacts a lower portion of the housing when the damper blade is in the closed position, wherein the damper blade extends across a width of the passageway and wherein the second end of the damper blade contacts a stop member when the damper blade is in the open position.

15. A method of modifying a transport refrigeration unit including a damper assembly comprising:

configuring the damper to operate in a closed position in a first mode of the transport refrigeration unit; and configuring the damper to vary a system capacity in a second mode of the transport refrigeration unit;

wherein a damper actuator comprises mechanical linkages to pass through a thermal barrier to operatively couple the damper actuator to the damper, wherein the first mode is a defrost mode and the second mode is a refrigeration mode, wherein the second mode the damper is moved among an open position and a plurality of intermediate positions between the open position and a closed position to vary a transport refrigeration unit capacity or a transport refrigeration unit humidity capacity.

16. The method of claim 15, further comprising providing at least one sensor operatively connected to the damper assembly.

17. A transport refrigeration unit including a compressor, a condenser downstream of said compressor, an expansion device downstream of said condenser, and an evaporator downstream of said expansion device, the transport refrigeration unit comprising:

a barrier to separate a first portion of the transport refrigeration unit to operate in a refrigerated environment from a second portion;

the evaporator in a refrigerated portion;

at least one damper door in the refrigerated portion;

an actuator mechanically coupled to move the damper door, the actuator is positioned in the second portion, the actuator to move the damper between an open position and a closed position;

wherein the transport refrigeration unit is configured to operate in a cooling mode and a defrost mode;

wherein a position of the damper door is moved when the transport refrigeration unit is to operate under conditions where ice can form in the refrigerated portion;

wherein the actuator is accessible via an access panel for the condenser in an ambient portion of the transport refrigeration unit.

18. The transport refrigeration unit of claim 17, where the actuator comprises a motor and bearing points to support movement of the damper door between the open position and the closed position.

19. The transport refrigeration unit of claim 18, wherein the damper door can be moved by manual operation of a portion of the actuator between the closed position and the open position.

20. The transport refrigeration unit of claim 17, where the second portion comprises an ambient portion, where the refrigerated portion of the transport refrigeration unit includes a passageway between an inlet and an outlet, and where the actuator is accessible from the ambient portion of the transport refrigeration unit.

21. The transport refrigeration unit of claim 17, where the transport refrigeration unit includes an insulated wall between a refrigerated portion and an ambient portion of the transport refrigeration unit, and comprising a damper assembly to pass through the insulated wall.

22. The transport refrigeration unit of claim 21, comprising a seal between the actuator and a first end of a damper shaft of the damper assembly.

23. The transport refrigeration unit of claim 17, wherein heat to defrost the evaporator is provided by operating the transport refrigeration unit in reverse, by resistive heat applied to the evaporator, or by providing heat from the compressor.

* * * * *